US011910867B2

(12) United States Patent
Cristobal et al.

(10) Patent No.: US 11,910,867 B2
(45) Date of Patent: Feb. 27, 2024

(54) ARTICLE OF FOOTWEAR WITH HEEL ENTRY DEVICE

(71) Applicant: NIKE, Inc., Beaverton, OR (US)

(72) Inventors: Stefan B. Cristobal, Portland, OR (US); Jeffery C. Gagatko, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 32 days.

(21) Appl. No.: 17/705,630

(22) Filed: Mar. 28, 2022

(65) Prior Publication Data

US 2023/0301394 A1 Sep. 28, 2023

(51) Int. Cl.
*A43B 11/00* (2006.01)

(52) U.S. Cl.
CPC ..... *A43B 11/00* (2013.01)

(58) Field of Classification Search
CPC .. A43B 11/00; A43B 3/30; A43B 3/06; A43B 23/0245; A43B 11/02; A43B 23/088; A43B 23/02; A43C 1/006; A43C 5/00
USPC ..... 36/56, 105
See application file for complete search history.

(56) References Cited

U.S. PATENT DOCUMENTS

| | | | |
|---|---|---|---|
| 4,497 | A | 5/1846 | Vetter |
| 75,048 | A | 3/1868 | Perley |
| 91,547 | A | 6/1869 | Leathe |
| 171,301 | A | 12/1875 | McKee |
| 219,436 | A | 9/1879 | Beneke |
| 417,460 | A | 12/1889 | Wurtele |
| 465,189 | A | 12/1891 | Morison |
| 474,574 | A | 5/1892 | Bruzon |

(Continued)

FOREIGN PATENT DOCUMENTS

| | | | |
|---|---|---|---|
| CN | 87209219 | U | 5/1988 |
| CN | 87103983 | A | 12/1988 |

(Continued)

OTHER PUBLICATIONS

Machine Translation of DE9412188U1 provided by Espacenet. https://worldwide.espacenet.com/publicationDetails/biblio?CC=DE& NR=9412188U1&KC=U1&FT=D&ND=3&date=19940922&DB=EPODOC&locale=en_EP Accessed Aug. 10, 2023. (Year: 2023).*

(Continued)

*Primary Examiner* — Clinton T Ostrup
*Assistant Examiner* — Brianna T. Duckworth
(74) *Attorney, Agent, or Firm* — Quinn IP Law

(57) ABSTRACT

An article of footwear comprises a sole structure and a footwear upper secured to the sole structure and defining an ankle opening. A device comprises a control bar having a center segment secured to a rear portion of the footwear upper rearward of the ankle opening, a medial side arm extending downwardly and forwardly from the center segment at a medial side of the footwear upper and fixed to the sole structure, and a lateral side arm extending downwardly and forwardly from the center segment at a lateral side of the footwear upper and fixed to the sole structure. The control bar depresses downward under an applied force to a loaded position as the side arms resiliently bend, storing potential energy that returns the control bar to an unloaded position upon removal of the applied force, the rear portion of the footwear upper moving with the control bar.

16 Claims, 9 Drawing Sheets

(56) References Cited

U.S. PATENT DOCUMENTS 503,588 A 8/1893 Elterich et al.
537,627 A 4/1895 Bixby et al.
558,937 A 4/1896 Edmonds
808,948 A 1/1906 Roberts
827,330 A 7/1906 Tillson
863,549 A 8/1907 Metz
882,109 A 3/1908 Harris
911,025 A 2/1909 Blaisdell
955,337 A 4/1910 Lawlor
1,028,598 A 6/1912 Papp
1,081,678 A 12/1913 Langerak
1,090,106 A 3/1914 Montine
1,155,354 A 10/1915 Hallock
1,275,895 A 8/1918 Fox
1,494,236 A 5/1924 Greathouse
1,585,049 A 5/1926 Skoglund
1,603,144 A 10/1926 Nichols
1,686,175 A 10/1928 Read
1,793,380 A 2/1931 Stone
1,812,622 A 6/1931 Costello
D98,150 S 1/1936 Drake
2,069,752 A 2/1937 Dorr
2,097,810 A 11/1937 Dawes
RE21,654 E 12/1940 Disch
2,252,315 A 8/1941 Doree
2,302,596 A 11/1942 Bigio
2,357,980 A 9/1944 Spiro
2,447,590 A 8/1948 Meltzer
2,450,250 A 9/1948 Napton
2,452,502 A 10/1948 Tarbox
2,452,649 A 11/1948 Graves
2,487,227 A 11/1949 Eberle
2,619,744 A 12/1952 Mattes
2,693,039 A 11/1954 Balut
2,736,110 A 2/1956 Hardimon
2,746,178 A 5/1956 Miller et al.
2,825,155 A 3/1958 Hines
2,920,402 A 1/1960 Minera
3,039,207 A 6/1962 Lincors
3,146,535 A 9/1964 Owings
3,192,651 A 7/1965 Smith
3,283,423 A 11/1966 Schovee
3,349,505 A 10/1967 Lopez
3,400,474 A 9/1968 Tendler
3,425,075 A 2/1969 Murray
3,436,842 A 4/1969 Sachs
3,681,860 A 8/1972 Bidegain
3,810,318 A 5/1974 Epstein
4,026,047 A 5/1977 Ahmer
4,030,213 A 6/1977 Daswick
4,095,356 A 6/1978 Robran et al.
4,136,468 A 1/1979 Munschy
4,309,832 A 1/1982 Hunt
4,402,146 A 9/1983 Parracho et al.
4,414,761 A 11/1983 Mahood
4,459,765 A 7/1984 Power
4,489,509 A 12/1984 Libit
4,507,879 A 4/1985 Dassler
4,559,724 A 12/1985 Norton
4,562,651 A 1/1986 Frederick et al.
4,566,206 A 1/1986 Weber
4,573,457 A 3/1986 Parks
4,594,798 A 6/1986 Autry et al.
4,599,811 A 7/1986 Rousseau
4,615,126 A 10/1986 Mathews
4,625,435 A 12/1986 Ueda
4,649,656 A 3/1987 Cox et al.
4,665,634 A 5/1987 Diaz
4,776,111 A 10/1988 Crowley
4,783,909 A 11/1988 Van Doren et al.
4,864,736 A 9/1989 Bierk
4,944,099 A 7/1990 Davis
4,972,613 A * 11/1990 Loveder ..... A43B 5/00 36/105
5,054,216 A 10/1991 Lin
5,060,401 A 10/1991 Whatley
5,090,140 A 2/1992 Sessa
5,127,170 A 7/1992 Messina
5,152,082 A 10/1992 Culpepper
5,181,331 A 1/1993 Berger
D333,377 S 2/1993 Hatfield
5,184,410 A 2/1993 Hamilton
5,222,313 A 6/1993 Dowdy et al.
5,276,983 A * 1/1994 Hatfield ..... A43B 11/00 36/1
5,279,051 A 1/1994 Whatley
5,282,327 A 2/1994 Ogle
5,317,819 A 6/1994 Ellis, III
5,341,583 A 8/1994 Hallenbeck
5,371,957 A 12/1994 Gaudio
5,467,537 A 11/1995 Aveni et al.
5,481,814 A 1/1996 Spencer
5,557,866 A 9/1996 Prengler
5,570,523 A 11/1996 Lin
5,678,330 A 10/1997 Van Dyke et al.
5,682,687 A 11/1997 Arai
5,787,608 A 8/1998 Greenawalt
5,813,144 A 9/1998 Prengler
5,822,888 A 10/1998 Terry
5,826,353 A 10/1998 Woznicki
5,839,210 A * 11/1998 Bernier ..... A43B 3/0078 36/138
5,842,292 A 12/1998 Siesel
D404,896 S 2/1999 Cooper
5,884,420 A 3/1999 Donnadieu
6,000,148 A 12/1999 Cretinon
6,079,128 A 6/2000 Hoshizaki et al.
6,189,239 B1 2/2001 Gasparovic et al.
6,298,582 B1 10/2001 Friton et al.
6,314,662 B1 11/2001 Ellis, III
6,360,454 B1 3/2002 Dachgruber et al.
6,378,230 B1 4/2002 Rotem et al.
6,438,872 B1 8/2002 Chil et al.
6,497,058 B2 12/2002 Dietrich et al.
6,557,271 B1 5/2003 Weaver, III
6,578,288 B2 6/2003 Bernstein
6,594,921 B2 7/2003 Laio et al.
6,643,954 B2 11/2003 Voswinkel
6,684,533 B1 2/2004 Su
6,718,658 B2 4/2004 Karasawa
6,726,225 B1 4/2004 Stewart et al.
6,817,116 B2 11/2004 Chil et al.
6,883,254 B2 4/2005 Miller et al.
6,925,732 B1 8/2005 Clarke
6,938,361 B2 9/2005 Su
6,957,504 B2 10/2005 Morris
6,964,119 B2 11/2005 Weaver, III
7,055,268 B2 6/2006 Ha
7,059,069 B2 6/2006 Raluy et al.
7,080,468 B2 7/2006 Miller et al.
7,082,702 B2 8/2006 Cretinon
7,101,604 B1 9/2006 Minges
7,103,994 B2 9/2006 Johnson
7,127,837 B2 10/2006 Ito
7,168,188 B2 1/2007 Auger et al.
7,168,190 B1 1/2007 Gillespie
7,178,270 B2 2/2007 Hurd et al.
7,188,438 B1 3/2007 Bowen
7,225,563 B2 6/2007 Chen et al.
7,284,341 B2 10/2007 Moseley
7,287,294 B2 10/2007 Miller et al.
7,392,603 B1 7/2008 Shepherd et al.
7,439,837 B2 10/2008 McDonald
7,448,148 B2 11/2008 Martinez et al.
7,472,495 B2 1/2009 Milbourn
7,526,881 B2 5/2009 Jones et al.
7,581,337 B2 9/2009 Miller et al.
7,607,242 B2 10/2009 Karandonis et al.
7,685,747 B1 3/2010 Gasparovic et al.
7,694,435 B1 4/2010 Kiser et al.
7,698,836 B2 4/2010 Schmelzer et al.
7,735,244 B1 6/2010 Ameche
7,793,438 B1 9/2010 Busse et al.
7,823,299 B1 11/2010 Brigham

(56) References Cited

U.S. PATENT DOCUMENTS 7,900,377 B1 3/2011 Perenich
7,905,033 B1 3/2011 Perenich
7,913,422 B1 3/2011 Perenich
7,950,166 B1 5/2011 Perenich
7,975,403 B2 7/2011 Mosher
8,006,410 B2 8/2011 Romboli et al.
8,020,317 B1 9/2011 Sokolowski
D648,512 S 11/2011 Schlageter et al.
8,056,264 B2 11/2011 Sato et al.
8,061,059 B2 11/2011 Bruce et al.
8,065,819 B2 11/2011 Kaufman
8,161,669 B2 4/2012 Keating
8,171,657 B1 5/2012 Perenich
8,215,030 B2 7/2012 Bowen et al.
8,225,534 B2 7/2012 Mueller et al.
8,225,535 B2 7/2012 Dillenbeck
8,245,418 B2 8/2012 Paintin et al.
8,245,421 B2 8/2012 Baudouin et al.
8,256,146 B2 9/2012 Loverin
8,365,443 B2 2/2013 Huynh
8,468,721 B2 6/2013 Sokolowski
8,468,723 B2 6/2013 Malka-Harari
8,499,474 B2 8/2013 Kaufman
8,539,698 B1 9/2013 Woodruff
8,549,774 B2 10/2013 Meschter et al.
8,627,582 B2 1/2014 Perenich
8,627,583 B2 1/2014 Perenich
8,635,791 B2 1/2014 Baudouin et al.
8,677,656 B2 3/2014 Nishiwaki et al.
8,745,893 B2 6/2014 Gavrieli et al.
8,763,275 B2 7/2014 Shalom et al.
8,769,845 B2 7/2014 Lin
8,834,770 B2 9/2014 Nakano
8,919,015 B2 12/2014 Holt et al.
9,015,962 B2 4/2015 Boudreau et al.
9,032,646 B2 5/2015 Perenich
9,061,096 B2 6/2015 Taylor et al.
9,089,184 B1 7/2015 Kiser et al.
9,095,188 B2 8/2015 Cavaliere
9,119,436 B1 9/2015 Ardell et al.
9,119,437 B2 9/2015 Weller et al.
9,144,262 B2 9/2015 Ardell et al.
9,173,451 B2 11/2015 Shim
9,226,543 B2 1/2016 Campbell
9,254,018 B2 2/2016 Bliss
9,265,305 B2 2/2016 Hatfield et al.
9,301,570 B2 4/2016 Hwang
9,314,055 B2 4/2016 Moran
9,392,843 B2 7/2016 Callahan et al.
9,398,785 B2 7/2016 Horacek
9,398,786 B2 7/2016 Gavrieli et al.
9,414,640 B2 8/2016 Nichols
9,433,256 B2 9/2016 Callahan et al.
9,480,299 B2 11/2016 Dinndorf et al.
D776,420 S 1/2017 Petrie
D781,561 S 3/2017 Gibson
9,675,132 B2 6/2017 Marshall
9,820,527 B2 11/2017 Pratt et al.
9,867,426 B2 1/2018 Conant et al.
9,877,542 B2 1/2018 Pratt
10,159,310 B2 12/2018 Sullivan
D853,707 S 7/2019 Flanagan et al.
D854,303 S 7/2019 Flanagan et al.
10,455,898 B1 10/2019 Orand et al.
10,617,174 B1 4/2020 Hopkins et al.
10,905,192 B1 2/2021 Cheney
2001/0005946 A1 7/2001 Brown
2001/0011430 A1 8/2001 Davis et al.
2001/0022434 A1 9/2001 Sauter et al.
2002/0112376 A1 8/2002 Tomat
2002/0124436 A1 9/2002 Hatfield et al.
2002/0133977 A1 9/2002 Pan
2002/0144434 A1 10/2002 Farys et al.
2002/0174568 A1 11/2002 Neiley
2004/0111921 A1 6/2004 Lenormand
2005/0016021 A1 1/2005 Marvin et al.
2005/0039348 A1 2/2005 Raluy et al.
2005/0060913 A1 3/2005 Chil et al.
2005/0066548 A1 3/2005 Chil et al.
2005/0081404 A1 4/2005 Hurd et al.
2005/0193594 A1 9/2005 Murphy
2006/0003160 A1 1/2006 Goldberg
2006/0032091 A1 2/2006 Kilgore
2006/0196079 A1 9/2006 Terlizzi et al.
2007/0011917 A1 1/2007 Hayes
2007/0039208 A1 2/2007 Bove et al.
2007/0074425 A1 4/2007 Leong
2007/0186441 A1 8/2007 Chen
2007/0199211 A1 8/2007 Campbell
2007/0199213 A1 8/2007 Campbell et al.
2007/0256332 A1 11/2007 Calderone
2008/0000106 A1 1/2008 Culpepper
2008/0005933 A1 1/2008 Auger et al.
2008/0083138 A1 4/2008 Lacorazza et al.
2008/0086911 A1 4/2008 Labbe
2008/0120871 A1* 5/2008 Sato ..... A43B 23/0235 36/114
2008/0141562 A1 6/2008 Peveto
2008/0155788 A1 7/2008 Wilcox
2008/0307673 A1 12/2008 Johnson
2008/0313929 A1 12/2008 Hoyt
2009/0025260 A1 1/2009 Nakano
2009/0113757 A1 5/2009 Banik
2009/0293318 A1 12/2009 Garneau et al.
2010/0319216 A1 12/2010 Grenzke et al.
2011/0016751 A1 1/2011 Somerville
2011/0083341 A1 4/2011 Baum
2011/0119959 A1 5/2011 Bodner
2011/0146106 A1 6/2011 Kaufman
2011/0185592 A1 8/2011 Nishiwaki et al.
2011/0214312 A1 9/2011 Krikelis
2011/0232130 A1 9/2011 Boudreau et al.
2012/0079742 A1 4/2012 Ferreira et al.
2012/0079746 A1 4/2012 Ferreira et al.
2012/0180338 A1 7/2012 Lin
2012/0192453 A1 8/2012 Raysse et al.
2012/0304491 A1 12/2012 Kimura et al.
2012/0317839 A1 12/2012 Pratt
2013/0074368 A1* 3/2013 Toraya ..... A43B 23/0245 36/83
2013/0185959 A1 7/2013 Coleman
2013/0219747 A1 8/2013 Lederer
2014/0013624 A1 1/2014 Stockbridge et al.
2014/0096415 A1 4/2014 Long
2014/0115925 A1 5/2014 Hurd et al.
2014/0173935 A1 6/2014 Sabbioni
2014/0202044 A1 7/2014 Adami et al.
2014/0250723 A1 9/2014 Kohatsu
2014/0259295 A1* 9/2014 Guglielmo ..... A43B 1/0027 2/245
2014/0259782 A1 9/2014 Dojan et al.
2014/0259788 A1 9/2014 Dojan et al.
2014/0259789 A1 9/2014 Dojan et al.
2014/0298687 A1 10/2014 Flinterman et al.
2014/0305005 A1 10/2014 Yeh
2014/0310992 A1 10/2014 Shalom et al.
2014/0360049 A1 12/2014 Panian et al.
2014/0360051 A1* 12/2014 Coulter ..... A43B 23/025 36/83
2015/0047227 A1 2/2015 Fallon et al.
2015/0113834 A1 4/2015 Dojan et al.
2015/0143720 A1 5/2015 Avar
2015/0196095 A1 7/2015 Chapman
2015/0216252 A1 8/2015 Wiens
2015/0289595 A1 10/2015 Rushbrook et al.
2015/0305432 A1 10/2015 Wiens
2016/0120259 A1 5/2016 Benetti
2016/0128429 A1 5/2016 Hatfield et al.
2016/0242493 A1 8/2016 Stillwagon
2016/0302530 A1 10/2016 Smith et al.
2016/0374427 A1 12/2016 Zahabian
2017/0042290 A1 2/2017 Hatfield et al.
2017/0055630 A1 3/2017 Marshall
2017/0119100 A1 5/2017 Yamada

(56) References Cited

U.S. PATENT DOCUMENTS

| | | | | |
|---|---|---|---|---|
| 2017/0127760 | A1 | 5/2017 | Arquilla | |
| 2017/0150773 | A1 | 6/2017 | Beers | |
| 2017/0150778 | A1 | 6/2017 | Youngs et al. | |
| 2017/0215517 | A1 | 8/2017 | Silva | |
| 2017/0258179 | A1 | 9/2017 | Conant et al. | |
| 2017/0265560 | A1 | 9/2017 | Beers et al. | |
| 2017/0303632 | A1 | 10/2017 | Pratt et al. | |
| 2017/0360143 | A1* | 12/2017 | Pratt | A43B 23/027 |
| 2018/0098601 | A1 | 4/2018 | Hartenstein et al. | |
| 2018/0104536 | A1 | 4/2018 | Stewart | |
| 2018/0110287 | A1 | 4/2018 | Hopkins et al. | |
| 2018/0110288 | A1 | 4/2018 | Hatfield et al. | |
| 2018/0110289 | A1 | 4/2018 | Owings et al. | |
| 2018/0110292 | A1* | 4/2018 | Beers | A43B 11/02 |
| 2018/0206588 | A1 | 7/2018 | Pratt et al. | |
| 2018/0235314 | A1 | 8/2018 | Farage | |
| 2018/0289109 | A1 | 10/2018 | Beers et al. | |
| 2018/0295942 | A1 | 10/2018 | Drake | |
| 2018/0338583 | A1 | 11/2018 | Sullivan | |
| 2019/0000186 | A1 | 1/2019 | Mou et al. | |
| 2019/0297999 | A1 | 10/2019 | Nakaya et al. | |
| 2020/0205516 | A1 | 7/2020 | Kilgore | |
| 2020/0205517 | A1 | 7/2020 | Happen | |
| 2020/0253333 | A1 | 8/2020 | Kilgore et al. | |
| 2020/0268107 | A1 | 8/2020 | Fuerst | |
| 2021/0112914 | A1 | 4/2021 | Cheney | |
| 2021/0112916 | A1 | 4/2021 | Schulten | |

FOREIGN PATENT DOCUMENTS

| | | | | |
|---|---|---|---|---|
| CN | 2052208 | U | 2/1990 | |
| CN | 2253129 | Y | 4/1997 | |
| CN | 1166998 | A | 12/1997 | |
| CN | 2438353 | Y | 7/2001 | |
| CN | 1403041 | A | 3/2003 | |
| CN | 1278639 | C | 10/2006 | |
| CN | 1943463 | A | 4/2007 | |
| CN | 2901950 | Y | 5/2007 | |
| CN | 201005111 | Y | 1/2008 | |
| CN | 101485505 | A | 7/2009 | |
| CN | 101528072 | A | 9/2009 | |
| CN | 201426430 | Y | 3/2010 | |
| CN | 201743039 | U | 2/2011 | |
| CN | 201831038 | U | 5/2011 | |
| CN | 201898951 | U | 7/2011 | |
| CN | 102365035 | A | 2/2012 | |
| CN | 101991227 | B | 8/2012 | |
| CN | 102770039 | A | 11/2012 | |
| CN | 102871329 | A | 1/2013 | |
| CN | 203828164 | U | 9/2014 | |
| CN | 203841187 | U | 9/2014 | |
| CN | 203884809 | U | 10/2014 | |
| CN | 203986373 | U | 12/2014 | |
| CN | 204070772 | U | 1/2015 | |
| CN | 104394729 | A | 3/2015 | |
| CN | 102595952 | B | 4/2015 | |
| CN | 104620675 | A | 5/2015 | |
| CN | 204519530 | U | 8/2015 | |
| CN | 205267152 | U | 6/2016 | |
| CN | 205568021 | U | 9/2016 | |
| CN | 205658453 | U | 10/2016 | |
| CN | 206025369 | U | 3/2017 | |
| CN | 106572720 | A | 4/2017 | |
| CN | 106998856 | A | 8/2017 | |
| CN | 107404968 | A | 11/2017 | |
| CN | 107874384 | A | 4/2018 | |
| CN | 108135329 | A | 6/2018 | |
| CN | 207544444 | U | 6/2018 | |
| CN | 108283341 | A | 7/2018 | |
| CN | 114343284 | A | 4/2022 | |
| DE | 3310988 | A1 | 9/1984 | |
| DE | 3928625 | A1 | 3/1991 | |
| DE | 9412188 | U1 * | 7/1994 | A43B 11/00 |
| DE | 19534249 | A1 | 3/1997 | |
| DE | 19611797 | A1 | 10/1997 | |
| DE | 29809404 | U1 | 8/1998 | |
| DE | 10247163 | A1 | 4/2004 | |
| DE | 102004005288 | A1 | 8/2005 | |
| DE | 102013200701 | A1 | 7/2013 | |
| EP | 0149362 | A2 | 7/1985 | |
| EP | 0570621 | A1 | 11/1993 | |
| EP | 1059044 | A1 | 12/2000 | |
| EP | 1952715 | A1 | 8/2008 | |
| EP | 2082658 | A1 | 7/2009 | |
| EP | 2204102 | A | 7/2010 | |
| EP | 2277402 | A2 | 1/2011 | |
| EP | 2490565 | A1 | 8/2012 | |
| EP | 2647303 | A1 | 10/2013 | |
| EP | 2818068 | A1 | 12/2014 | |
| EP | 2848141 | A1 | 3/2015 | |
| EP | 3167742 | A1 | 5/2017 | |
| FR | 1083503 | A | 1/1955 | |
| FR | 2994800 | A1 | 3/2014 | |
| GB | 503525 | A | 4/1939 | |
| GB | 603525 | A | 6/1948 | |
| GB | 1154145 | A | 6/1969 | |
| GB | 1358470 | A | 7/1974 | |
| GB | 2517148 | A | 2/2015 | |
| GB | 2517399 | A | 2/2015 | |
| GB | 2533809 | A | 7/2016 | |
| IN | 105658105 | A | 6/2016 | |
| JP | H0181910 | U | 6/1989 | |
| JP | 2000139502 | A | 5/2000 | |
| JP | 2001149394 | A | 6/2001 | |
| JP | 2002262907 | A | 9/2002 | |
| JP | 2003210206 | A | 7/2003 | |
| JP | 2004236860 | A | 8/2004 | |
| JP | 2004344396 | A | 12/2004 | |
| JP | 2005532115 | A | 10/2005 | |
| JP | 2006055571 | A | 3/2006 | |
| JP | 2008206629 | A | 9/2008 | |
| JP | 2010042224 | A | 2/2010 | |
| JP | 2012061046 | A | 3/2012 | |
| JP | 5157019 | B2 | 3/2013 | |
| KR | 20010105550 | A | 11/2001 | |
| KR | 20090093548 | A | 9/2009 | |
| KR | 20090130804 | A | 12/2009 | |
| KR | 101841085 | B1 | 3/2018 | |
| TW | M318332 | U | 9/2007 | |
| TW | 200930315 | A | 7/2009 | |
| TW | 201215342 | A | 4/2012 | |
| TW | I581730 | B | 5/2017 | |
| WO | 8808678 | A1 | 11/1988 | |
| WO | 0187106 | A2 | 11/2001 | |
| WO | 03039283 | A1 | 5/2003 | |
| WO | 2005029991 | A1 | 4/2005 | |
| WO | 2006084185 | A1 | 8/2006 | |
| WO | 2007024875 | A2 | 3/2007 | |
| WO | 2007080205 | A1 | 7/2007 | |
| WO | 2008115743 | A1 | 9/2008 | |
| WO | 2008152414 | A1 | 12/2008 | |
| WO | 2009154350 | A1 | 12/2009 | |
| WO | 2010048203 | A1 | 4/2010 | |
| WO | 2010059716 | A2 | 5/2010 | |
| WO | 2010114993 | A1 | 10/2010 | |
| WO | 2011004946 | A1 | 1/2011 | |
| WO | 2012044974 | A1 | 4/2012 | |
| WO | 2012168956 | A1 | 12/2012 | |
| WO | 2013187288 | A1 | 12/2013 | |
| WO | 2014033396 | A1 | 3/2014 | |
| WO | 2014140443 | A1 | 9/2014 | |
| WO | 2015002521 | A1 | 1/2015 | |
| WO | 2015183486 | A1 | 12/2015 | |
| WO | 2016002412 | A1 | 1/2016 | |
| WO | 2016005696 | A1 | 1/2016 | |
| WO | 2016015161 | A1 | 2/2016 | |
| WO | 2017184943 | A1 | 10/2017 | |
| WO | 2020226723 | A1 | 11/2020 | |

OTHER PUBLICATIONS

Merrell Winter Climbing Shoes Polar Land 6 Released, Stylogue.co.kr, https://blog.naver.com/th_media/220192038921, Nov. 26, 2014.

(56) References Cited

OTHER PUBLICATIONS

Erwin Ramos, Nike LunarGlide+ 3 Running Shoes Review, Running Shoes Guru, Sep. 15, 2012, https://www.runningshoesguru.com/2011/08/nike-lunarglide-3-running-shoes-review/.
ShoeLander23, Nike Running Officially Releases the Nike LunarGlide 7, WearTesters, Jun. 24, 2015, https://weartesters.com/nike-running-officially-releases-the-nike-lunarglide-7/.
Solereview Editors, Nike Lunarglide 4 review, Solereview, Published: Jun. 24, 2012, https://www.solereview.com/nike-lunarglide-5-review/.
Solereview Editors, Nike Lunarglide 5 review, Solereview, Published: Aug. 18, 2013, https://www.solereview.com/nike-lunarglide-5-review/.
Solereview, Nike Lunarglide 6 review, Solereview, Published: Jul. 4, 2014, https://www.solereview.com/nike-lunarglide-6-review/.
CN101528072 (A): An English language Abstract of the foreign language document is provided herewith, which was obtained from Espacenet (http://worldwide.espacenet.com). Additionally, according to the Bibliographic data available on Espacenet (http://worldwide.espacenet.com), this foreign language reference is also published in English, for instance as U.S. Application Publication No. 20080078101.
JP2010042224 (A): An English language Abstract of the foreign language document is provided herewith, which was obtained from Espacenet (http://worldwide.espacenet.com).
CN204070772 (U): An English language Abstract of the foreign language document is provided herewith, which was obtained from Espacenet (http://worldwide.espacenet.com).
CN2253129 (Y): An English language Abstract of the foreign language document is provided herewith, which was obtained from Espacenet (http://worldwide.espacenet.com).
TWM318332 (U): No of the application is available in English. A machine translation of the foreign language document is provided herewith, which was obtained from TWPAT(https://twpat-simple.tipo.gov.tw).
Aidin H., Under Armour's Innovative Fall/Winter 2016 Collection Now Available at All Brand Houses, Aug. 27, 2016, https://www.runsociety.com/news/under-armours-innovative-fallwinter-2016-collection-now-available-at-all-brand-houses/ (accessed Nov. 4, 2017).
Kizik Design, Kizik® Shoes Launch Footwear Revolution with Patented Handsfree Technology, https://www.prnewswire.com/news-releases/kizik-shoes-launch-footwear-revolution-with-patented-handsfree-technology-300594838.html, Feb. 7, 2018.
Nike Ease Challenge Winner Announced, Nike News, Apr. 25, 2017, https://news.nike.com/news/nike-ease-challenge-winner-announced (accessed May 2, 2018).
U.S. Appl. No. 61/260,621, filed Nov. 12, 2009.
U.S. Appl. No. 62/326,650, filed Apr. 22, 2016.
U.S. Appl. No. 62/368,497, filed Jul. 29, 2016.
U.S. Appl. No. 62/486,311, filed Apr. 17, 2017.
Anonymous, "Rivets Two Piece Snap Rivets ITW Fastex", Jan. 30, 2008, XP55669700, Retrieved from the Internet: URL: http://www.itw-fastex.com/catalog/index.php/dw/op/a/6/c/14/p/27?m=no#specs.

* cited by examiner

ARTICLE OF FOOTWEAR WITH HEEL ENTRY DEVICE

TECHNICAL FIELD

The present disclosure generally relates to a device for easing foot entry into an article of footwear and to an article of footwear that includes the device at a heel region of the article of footwear.

BACKGROUND

Traditionally, placing footwear on a foot often requires the use of one or both hands to enlarge the ankle opening of a footwear upper, and hold the rear portion during foot insertion, especially in the case of a relatively soft upper and/or an upper that does not have a heel counter secured to a flexible fabric rearward of the ankle opening. These steps may be difficult for some wearers, such as those with limited dexterity and young children.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
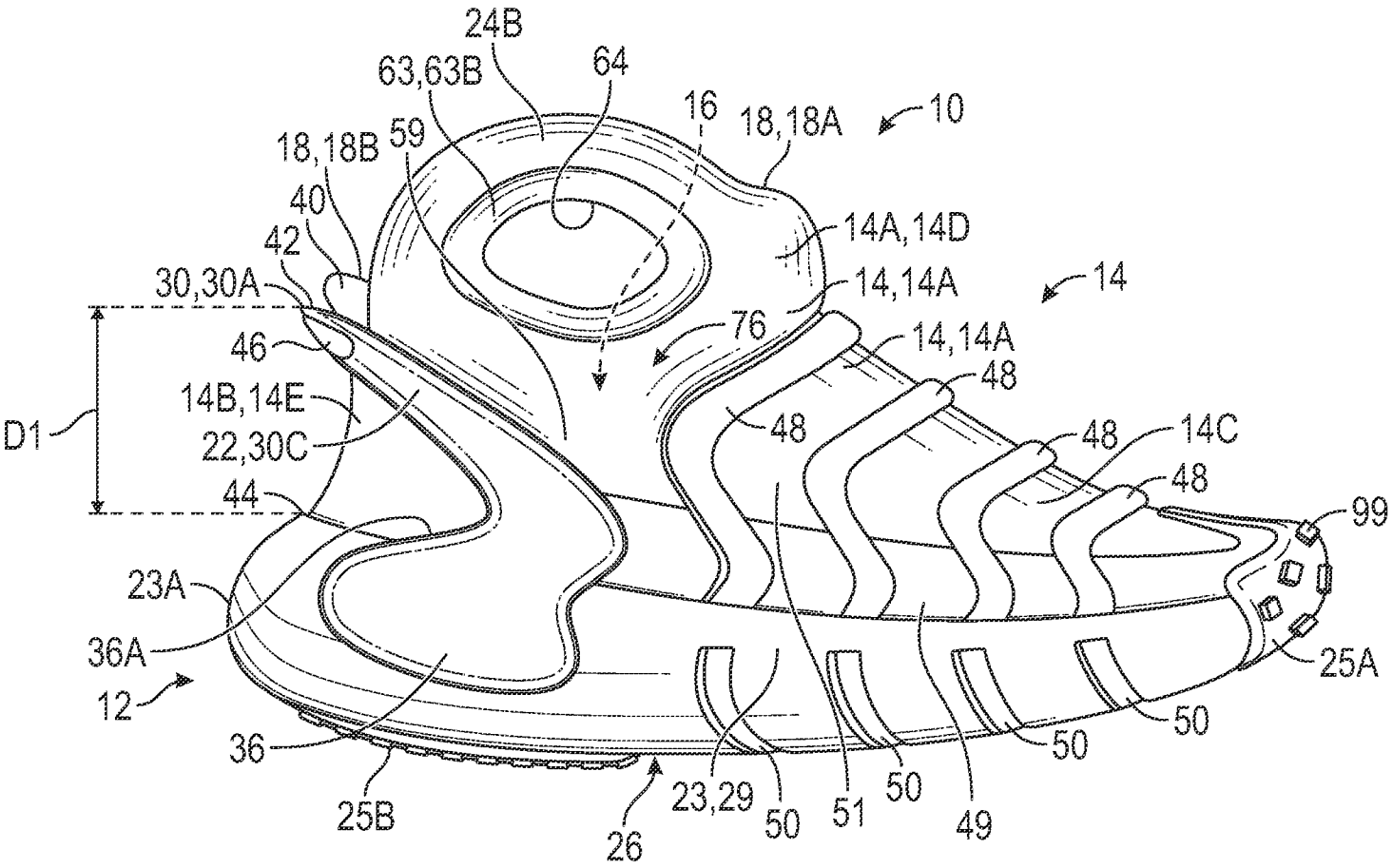
FIG. 1 is a lateral side view of an article of footwear including a device for easing foot entry shown in an unloaded position and including a handle for easing foot entry.

Various embodiments of a device for easing foot entry into an article of footwear are disclosed herein. The device may enable hands-free foot entry, such as by loading the device with the foot to access a foot-receiving cavity from a rearward position, and sliding the foot forward and downward into the foot-receiving cavity. Optionally, a hand or hands may be used in conjunction with the device to ease foot entry. For example, the footwear upper may include a grab handle for pulling on the upper during foot entry. The footwear upper may have a boot configuration. The footwear may be implemented for all sizes and ages.

In an example, an article of footwear comprises a sole structure and a footwear upper secured to the sole structure. The footwear upper defines an ankle opening. The article of footwear includes a device for easing foot entry. The device comprises a control bar having a center segment, a medial side arm, and a lateral side arm. The center segment is secured to a rear portion of the footwear upper rearward of the ankle opening. The medial side arm extends downwardly and forwardly from the center segment at a medial side of the footwear upper and is fixed to the sole structure. The lateral side arm extends downwardly and forwardly from the center segment at a lateral side of the footwear upper and is fixed to the sole structure. The control bar depresses downward under an applied force to a loaded position as the medial side arm and the lateral side arm resiliently bend, storing potential energy that returns the control bar to an unloaded position upon removal of the applied force. The rear portion of the footwear upper moves with the control bar. Accordingly, when a foot depresses the control bar, it becomes easy to slide the foot through the ankle opening into the foot-receiving cavity.

The footwear upper may have at least one of a medial grab handle at the medial side of the footwear upper or a lateral grab handle at a lateral side of the footwear upper. For example, a hand may be used to pull the upper via the grab handle(s) while the foot is entering the foot-receiving cavity. Concurrent use of the grab handle(s) with the control bar further eases foot entry, especially in a boot configuration of the footwear upper. It is typically challenging to gain foot entry into footwear having a boot configuration given elongation of the upper and the longer entry through the ankle opening above the sole structure. The combination of the device and the grab handle(s) alleviates these issues. The rear portion of the upper may be relatively lower than the front portion at the ankle opening, providing easy access to the center segment. The grab handle(s) enable the relatively higher front upper portion to be pulled onto the foot. Entry may be possible in a hands-free manner without using the grab handle(s), but the availability of the grab handle(s) enables even easier donning of the footwear when used to pull the front portion of the upper onto the foot at the same time that the foot is depressing the device and sliding into the foot-receiving cavity.

In another example, an article of footwear comprises a sole structure and a footwear upper having a front upper portion secured to the sole structure and a rear upper portion secured to the sole structure. The front upper portion defines a front of an ankle opening and the rear upper portion defines a rear of the ankle opening. The article of footwear includes a device comprising a control bar that has a center segment, a medial side arm, and a lateral side arm. The center segment is secured to the rear upper portion rearward of the ankle opening. The medial side arm extends downwardly and forwardly from the center segment at a medial side of the article of footwear outward of the footwear upper and is fixed to the sole structure. The lateral side arm extends downwardly and forwardly from the center segment at a lateral side of the article of footwear outward of the footwear upper and is fixed to the sole structure. The control bar depresses under an applied force to a loaded position as the medial side arm and the lateral side arm resiliently bend, storing potential energy that returns the control bar to an unloaded position upon removal of the applied force, the rear upper portion moving with the control bar. The front upper portion and the rear upper portion overlap at and are at least partially decoupled from one another at the medial side and at the lateral side to enable movement of the rear upper portion with the control bar with less restriction from and partially independently of the front upper portion. This decoupling of the front upper portion and the rear upper portion may enable the ankle opening to open to a greater extent when the control bar is depressed than if the front upper portion were more fully coupled to the rear upper portion.

The above features and advantages and other features and advantages of the present teachings are readily apparent from the following detailed description of the modes for carrying out the present teachings when taken in connection with the accompanying drawings. It should be understood that even though in the following Figures embodiments may be separately described, single features thereof may be combined to additional embodiments.

FIG. 1 shows an article of footwear 10 that includes a sole structure 12 and a footwear upper 14 secured to the sole structure 12. The footwear upper 14 and the sole structure 12 together define a foot-receiving cavity 16, and the footwear upper 14 defines an ankle opening 18 through which a foot (see foot 20 in FIG. 2) is inserted into the foot-receiving cavity 16. The footwear upper 14 and the sole structure 12 are described in greater detail herein.

The article of footwear 10 is depicted as a boot. However, within the scope of the present teachings, the features of the article of footwear 10 may be implemented in an athletic shoe, a dress shoe, a work shoe, a sandal, a slipper, or any other category of footwear. The article of footwear 10 may be implemented in any footwear size, including adult and children's sizes. The article of footwear 10 shown is for a right foot and is sized for a toddler. A pair of footwear includes the article of footwear 10, and an article of footwear that is a mirror image of the article of footwear 10 and for a left foot.

Traditionally, slipping a foot into a foot-receiving cavity of an article of footwear often requires the use of one or both hands to stretch the ankle opening and hold the rear portion of the upper during foot insertion, especially in the case of a relatively soft footwear upper and/or a footwear upper that does not have a heel counter. Footwear having a boot configuration may be especially challenging to gain foot entry given the longer entry through the ankle opening above the sole structure.

As further discussed herein, the article of footwear 10 includes a device 22 for easing foot entry into the foot-receiving cavity 16, and the footwear upper 14 is configured to be complementary to the use of the device 22. Additionally, the footwear upper 14 includes one or both of a medial grab handle 24A (see FIG. 3) and a lateral grab handle 24B to further easing foot entry, especially in light of the footwear upper 14 having a boot configuration.

The combination of the device 22 and the grab handle(s) 24A, 24B alleviates difficulties of donning footwear with a boot configuration. A relatively low rear upper portion 14B of the footwear upper 14 provides easy access of the foot 20 (shown in phantom in FIG. 2) to a depressible center segment 30A of the device 22 while the one or both grab handles 24A, 24B enable a relatively high front upper portion 14A to be pulled onto the foot (see hand 21 shown in phantom in FIG. 2 holding the grab handle 24B to pull the front upper portion 14A onto the foot 20). Entry may be possible using the device 22 only in a hands-free manner without using the grab handles 24A, 24B, but their availability enables even easier donning of the footwear 10 when they are used to pull the boot-like front upper portion 14A onto the foot 20 at the same time that the foot 20 is depressing the device 22 and sliding into the foot-receiving cavity 16.

Figure 2:
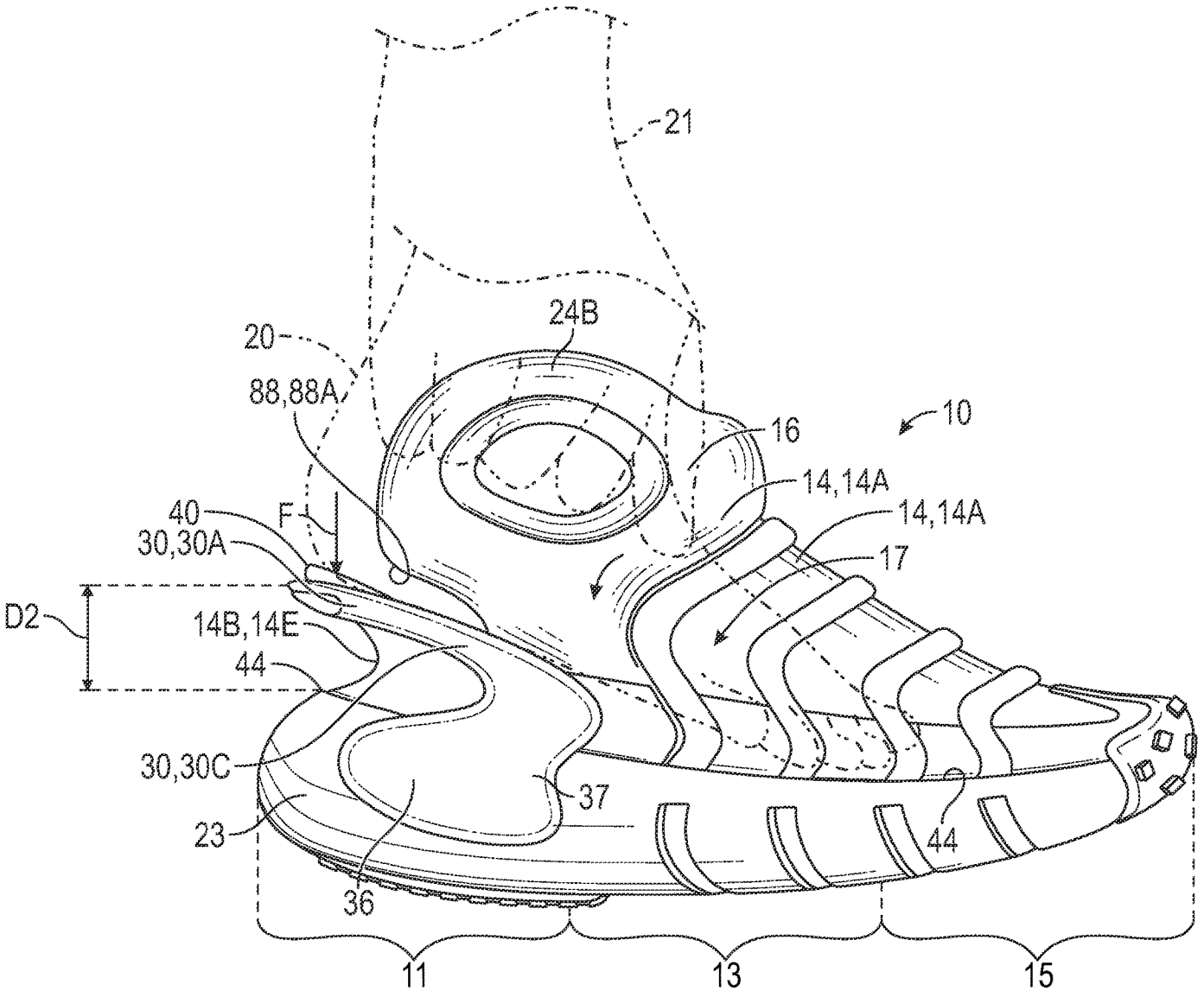
FIG. 2 is a lateral side view of the article of footwear of FIG. 1 with the device shown in a loaded position and showing a foot and a hand in phantom.

With reference to FIG. 2, the article of footwear 10 includes a heel region 11, a midfoot region 13, and a forefoot region 15. The heel region 11 generally includes portions of the article of footwear 10 corresponding with rear portions of a human foot (such as foot 20 shown in phantom in FIG. 2), including the calcaneus bone, when the human foot is supported on the sole structure 12 in the foot-receiving cavity 16 and is a size corresponding with the article of footwear 10. The forefoot region 15 of the article of footwear 10 generally includes portions of the article of footwear 10 corresponding with the toes and the joints connecting the metatarsals with the phalanges of the human foot (interchangeably referred to herein as the "metatarsal-phalangeal joints" or "MPJ" joints). The midfoot region 13 of the article of footwear 10 is disposed between the heel region 11 and the forefoot region 15 and generally includes portions of the article of footwear 10 corresponding with an arch area of the human foot, including the navicular joint.

Figure 5:
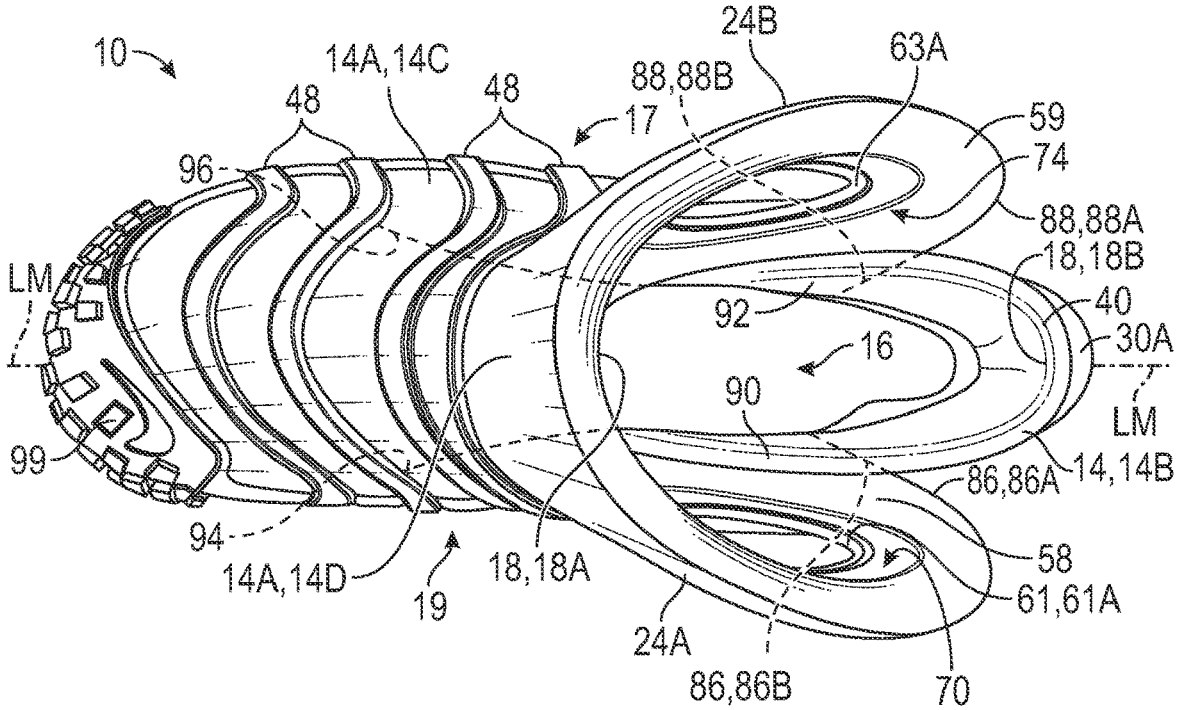
FIG. 5 is a top view of the article of footwear of FIG. 1.

The article of footwear 10 includes a lateral side 17 (see FIG. 2) and a medial side 19 (see FIG. 3) disposed on opposite sides of a longitudinal midline LM from one another, as shown in FIG. 5. The lateral side 17 and the medial side 19 extend through each of forefoot region 15, the midfoot region 13, and the heel region 11, and correspond with opposite sides of the article of footwear 10. The lateral side 17 is a side that corresponds with an outside area of the human foot (i.e., the side closer to the fifth toe of the wearer). The fifth toe is commonly referred to as the little toe. The medial side 19 is the side that corresponds with an inside area of the human foot (i.e., the side closer to the hallux of the foot of the wearer). The hallux is commonly referred to as the big toe. Both the lateral side 17 and the medial side 19 extend from a foremost extent to a rearmost extent of the article of footwear 10. These descriptions of the relative positions of the heel region 11, the midfoot region 13, the forefoot region 15, the medial side 19, and the lateral side 17 of the article of footwear 10 may also be used to describe portions or components of the article of footwear 10, including the footwear upper 14, the sole structure 12, the device 22, and individual components thereof.

Figure 3:
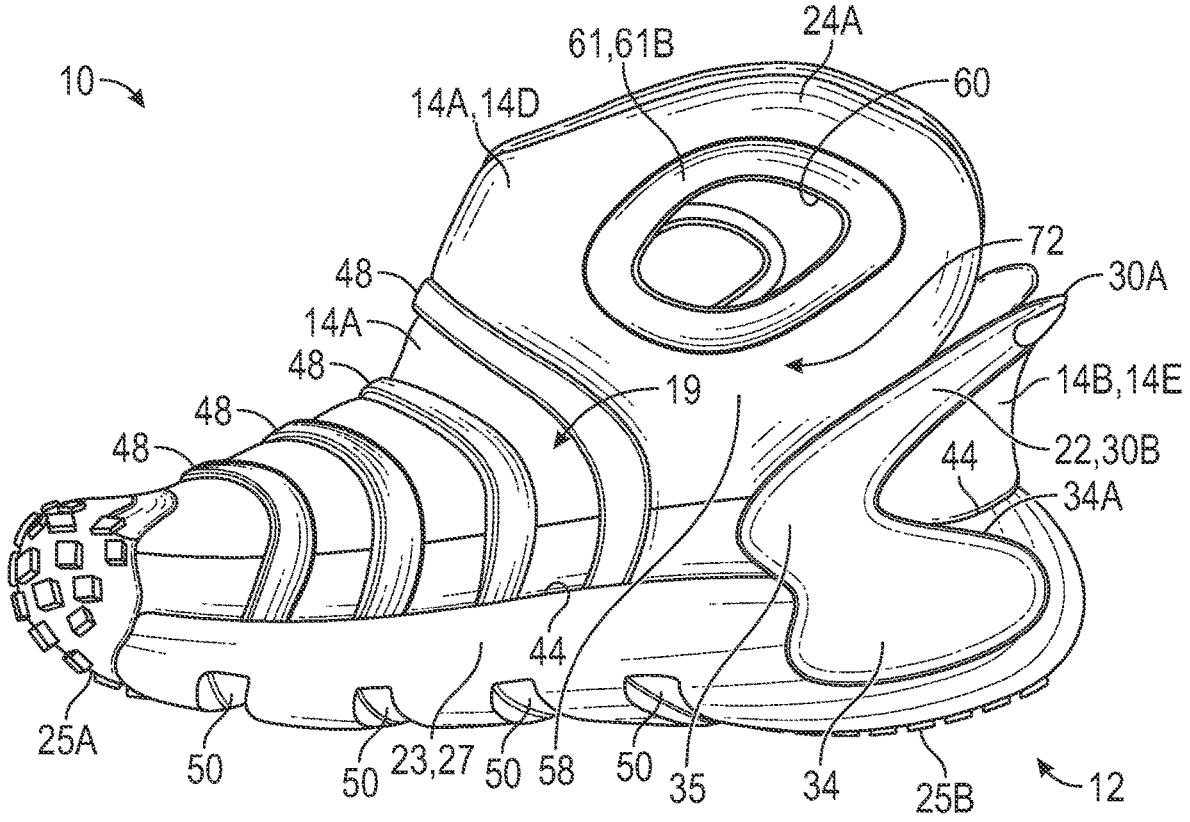
FIG. 3 is a medial side view of the article of footwear of FIG. 1.
Figure 6:
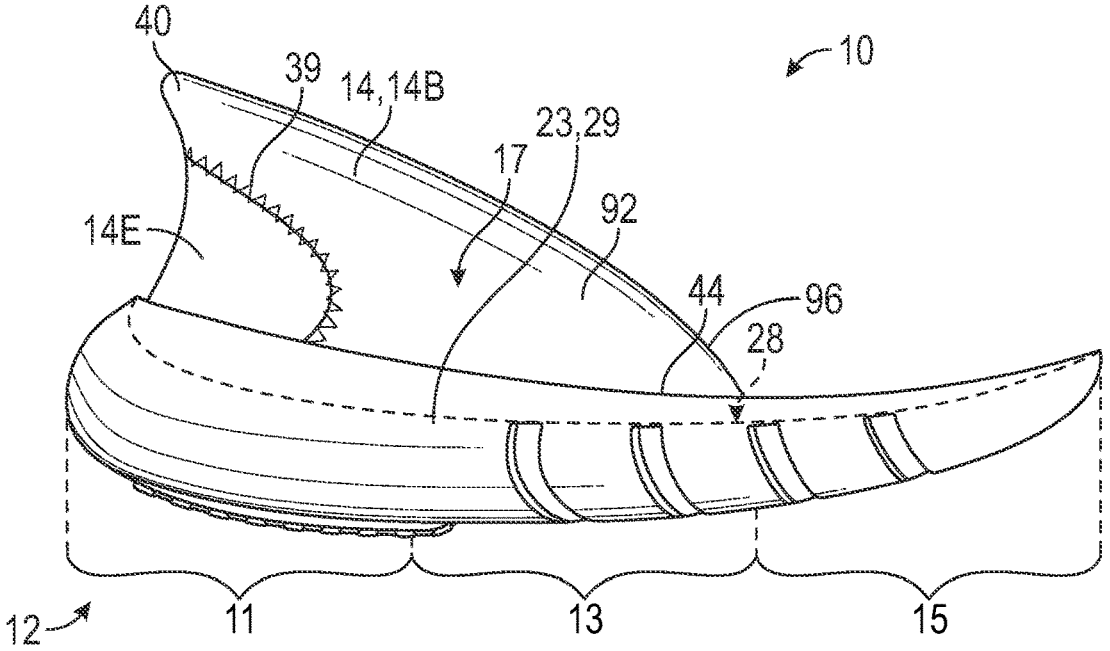
FIG. 6 is a lateral side view of the article of footwear of FIG. 1 showing only a sole structure and a rear upper portion, with a front upper portion and the device for easing foot entry not shown for clarity.
Figure 7:
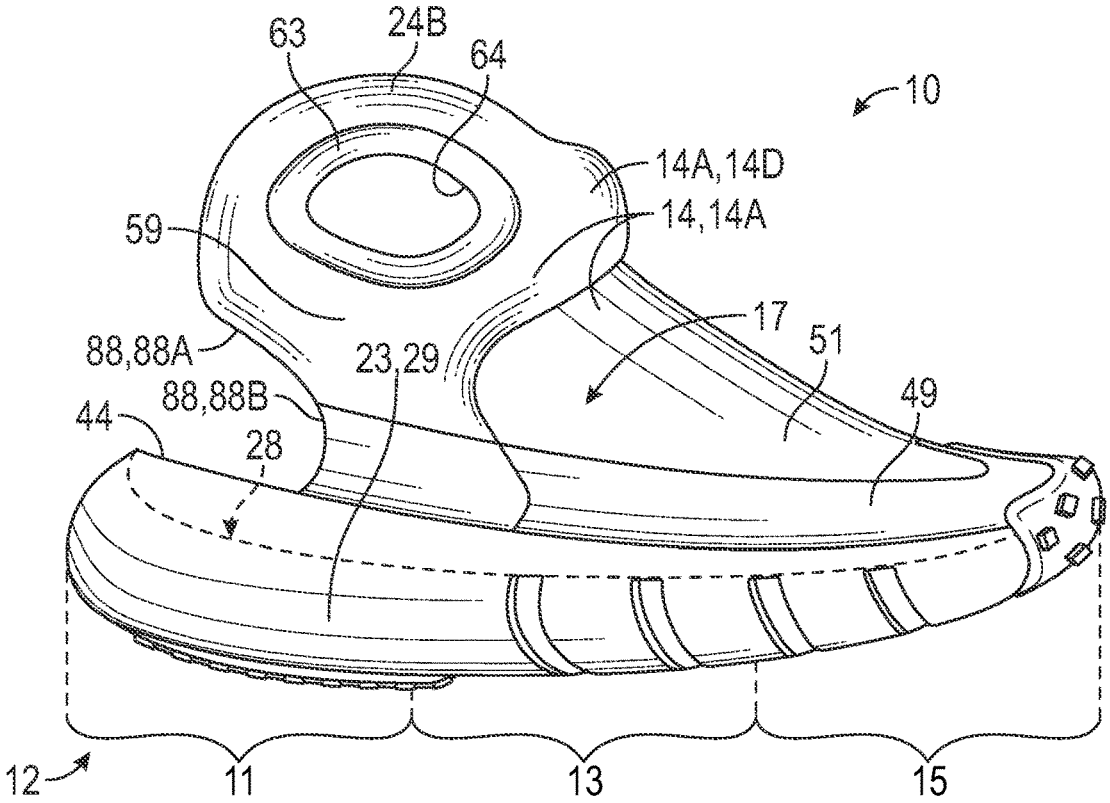
FIG. 7 is a lateral side view of the article of footwear of FIG. 1 showing only the sole structure and a front upper portion, with the rear upper portion and the device for easing foot entry not shown for clarity.

The footwear upper 14 has a front upper portion 14A secured to the sole structure 12 and a rear upper portion 14B (also referred to as a rear portion) that is also secured to the sole structure 12. The sole structure 12 includes a midsole 23, a front outsole component 25A, and a rear outsole component 25B. The outsole components 25A, 25B are secured to the midsole 23 at a ground-facing surface 26 of the midsole 23 and are spaced apart from one another. The front outsole component 25A is in the forefoot region 15 and the rear outsole component 25B is in the heel region 11. A lower extent of the front upper portion 14A and a lower extent of the rear upper portion 14B may be secured to a foot-facing surface 28 of the midsole 23 or to a strobel disposed on the foot-facing surface 28. The foot-facing surface 28 may be recessed inward of medial and lateral side walls 27, 29 of the midsole 23 and below an upper peripheral edge 44 of the midsole 23, as represented in FIGS. 6 and 7. The medial side wall 27 is shown in FIG. 3 and the lateral side wall 29 is shown in FIG. 1. The front upper portion 14A is shown with only the sole structure 12 in FIG. 7 and the rear upper portion 14B is shown with only the sole structure 12 in FIG. 6. Stated differently, the front upper portion 14A and the device 22 are removed in FIG. 6, and the rear upper portion 14B and the device 22 are removed in FIG. 7.

The front upper portion 14A defines a front 18A of the ankle opening 18 as best shown in FIG. 5. The rear upper portion 14B defines a rear 18B of the ankle opening 18. The front upper portion 14A includes a vamp portion 14C and an ankle portion 14D integral with the vamp portion 14C and disposed at the front 18A of the ankle opening 18. The ankle portion 14D also extends around the medial side 19 and the lateral side 17 and includes the medial and lateral grab handles 24A, 24B, as best shown in FIG. 5 and outer side walls 58, 59 discussed herein.

The device 22 includes a control bar 30 that has a center segment 30A, a medial side arm 30B (see FIG. 3), and a lateral side arm 30C. The device 22 is configured to surround a portion of the foot-receiving cavity 16 at the heel region 11 of the article of footwear 10. The medial side arm 30B extends downwardly and forwardly from the center segment 30A at the medial side 19 of the footwear upper 14 outward of the footwear upper 14 and is fixed to the sole structure 12. The lateral side arm 30C extends downwardly and forwardly from the center segment 30A at the lateral side 17 of the footwear upper 14 outward of the footwear upper 14 and is fixed to the sole structure 12.

Figure 4:
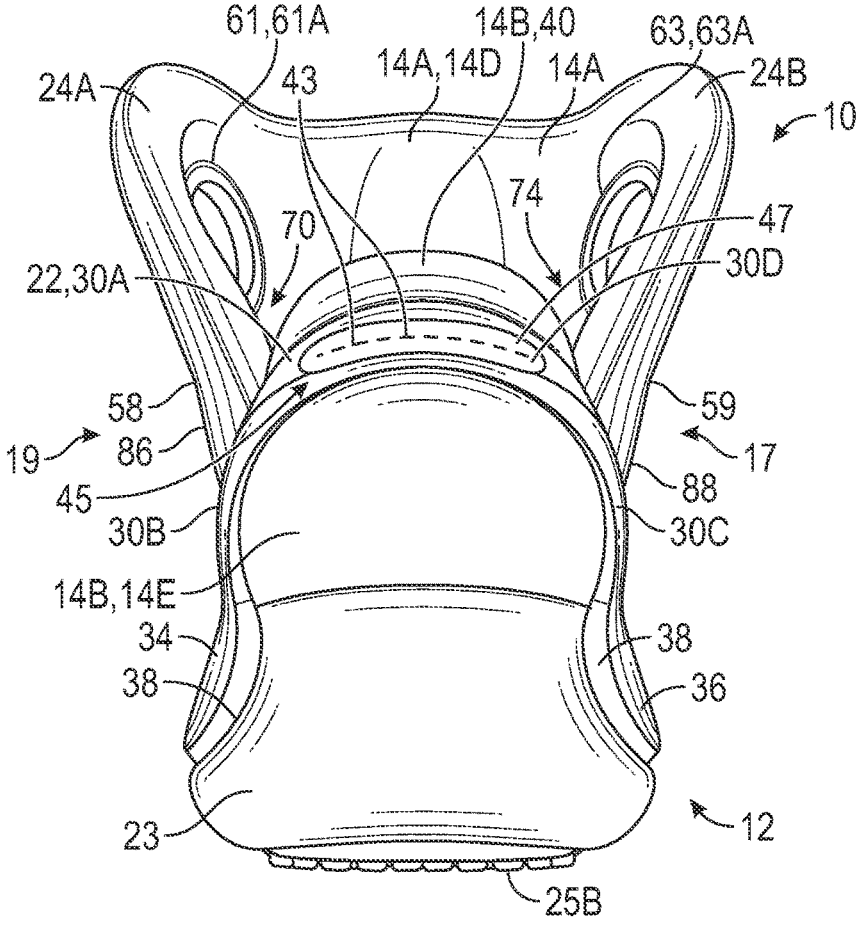
FIG. 4 is a rear view of the article of footwear of FIG. 1 showing stitching of the rear portion of the footwear upper to the device, with a cover that is shown in FIG. 1 removed in FIG. 4 to reveal the stitching.

The medial side arm 30B includes a medial terminal end 34 of the device 22 that terminates on and is secured to the medial side wall 27 of the midsole 23 of the sole structure 12, as shown in FIG. 3. The lateral side arm 30C includes a lateral terminal end 36 of the device 22 that terminates on and is secured to a lateral side wall 29 of the midsole 23 of the sole structure 12 as shown in FIG. 1. The exterior surface of the midsole 23 may have recesses 38 at the medial and lateral side walls 27, 29 in which the medial terminal end 34 and the lateral terminal end 36 are nested, as indicated in FIG. 4. The ends 34, 36 may be referred to as a base of the device, or the midsole 23 may be considered to be a base.

Figure 10:
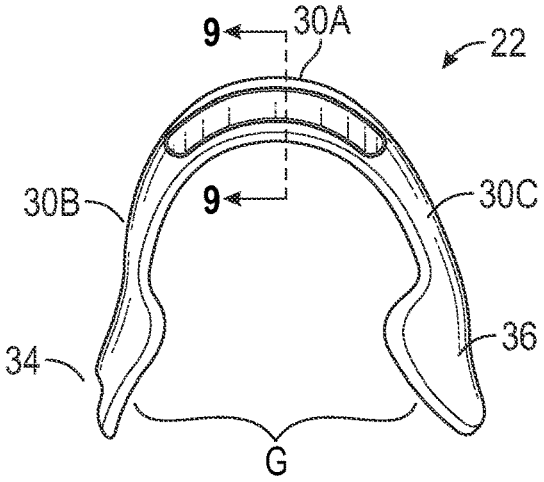
FIG. 10 is a rear view of the device for easing foot entry.

As best shown in FIG. 10, the device defines a gap G between the medial terminal end 34 and the lateral terminal end 36. The device 22 does not extend around the rear 23A of the sole structure 12 between the medial terminal end 34 and the lateral terminal end 36. Stated differently, the medial terminal end 34 and the lateral terminal end 36 are only connected to one another via the side arms 30B, 30C and the center segment 30A.

The footwear upper 14 extends further above the sole structure 12 at the front 18A of the ankle opening 18 than at the rear 18B of the ankle opening near the center segment 30A. In fact, the front upper portion 14A of the footwear upper 14 extends above the ankle of a wearer. Stated differently, the front upper portion 14A of the footwear upper 14 has a boot configuration.

The device 22 is a single, unitary, one-piece component that includes the control bar 30 having the center segment 30A, the medial side arm 30B (see FIG. 3), and the lateral side arm 30C. For example, the device 22 may be injection molded as a single, unitary, one-piece component. The material of the device 22 is selected to provide the ability to elastically deform to a loaded position shown in FIG. 2 by elastic bending as described herein, and store potential energy, such as elastic energy, that returns the device 22 to an unloaded position shown in FIG. 1. Example materials for the device 22 include plastics (such as thermoplastics), composites, and nylon. Another example material for the device 22 is a polyether block amide such as PEBAX® available from Arkema, Inc. in King of Prussia, Pennsylvania USA. The control bar 30 is biased to the unloaded position shown in FIG. 1. The unloaded position is also referred to herein as an unstressed position. The control bar 30 is internally biased to the unloaded position by its material in its formed state. Stated differently, the material of the control bar 30 is sufficiently rigid that it remains in the unloaded position in its formed state without external loads applied to it, and will return to the unloaded position after elastically bending under an applied force due to its resiliency.

The rear upper portion 14B is secured to the center segment 30A and terminates at the medial side 19 and at the lateral side 17 of the footwear upper 14 inward of the medial side arm 30B and the lateral side arm 30C and forward of the center segment 30A, as best shown in FIGS. 5 and 6.

The center segment 30A of the device 22 is secured to a rear portion of the footwear upper 14 rearward of the rear 18B of the ankle opening 18. More specifically, the rear upper portion 14B includes a heel portion 14E that extends in the gap G of FIG. 10 between the medial side arm 30B and the lateral side arm 30C and from the center segment 30A to the midsole 23 as best shown in FIG. 4. An inner collar, also referred to as a rear collar 40 is stitched to the heel portion 14E at stitching 39 as shown in FIG. 6. The center segment 30A is secured to the rear upper portion 14B at the rear collar 40 rearward of the rear 18B of the ankle opening 18.

Figure 9:
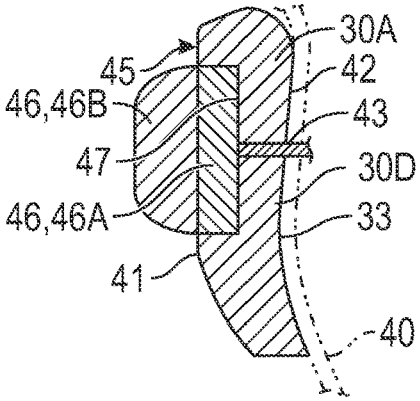
FIG. 9 is a cross-sectional view of the device for easing foot entry taken at lines 9-9 in FIG. 10.

Referring to FIG. 4, the center segment 30A has a thinned portion 30D at which the rear collar 40 of the rear upper portion 14B is stitched. More specifically, the center segment 30A has a rear-facing exterior surface 45 with a recess 47, as best seen in FIG. 9. The thinned portion 30D is at the recess 47. More specifically, the rear collar 40 is stitched to the thinned portion 30D with stitches 43 that extend through the thinned portion 30D and the rear collar 40. Stated differently, the rear collar 40 is stitched to the center segment 30A at the recess 47 with the stitches 43. The stitches 43 are shown in FIG. 4. One stitch 43 is shown for purposes of illustration in FIG. 9, and the rear collar 40 is shown only in fragmentary phantom view in FIG. 9.

The portion of the center segment 30A that surrounds the thinned portion 30D is thicker from an inner side 33 to an outer (exterior) side 41 of the center segment 30A than at the thinned portion 30D, as best shown in FIG. 9, and the thinned portion 30D is thus relatively thin. The thinned portion 30D may be created when the device 22 is molded or otherwise formed. The thinned portion 30D is sufficiently thin that the rear collar 40 is stitched to the device 22 by stitches 43 that extend through the upper 14 at the rear collar 40 and through the thinned portion 30D. This enables the heel portion 14E of the upper 14 to move with the center segment 30A of the control bar 30 to the loaded position of FIG. 2 as described herein.

In order to protect the stitches 43 and also for aesthetic purposes, a cover 46 is disposed in the recess 47 over the stitches 43. The cover 46 is removed in FIG. 4 for clarity. The cover 46 is shown in FIG. 1 as well as in FIG. 9. In the cross-sectional view of FIG. 9, it is apparent that the cover 46 has a first layer 46A and a second layer 46B. The first layer 46A is inward of the second layer 46B, is disposed in the recess 47, and may be referred to as an inner cover layer. The second layer 46B is secured to the first layer 46A and is outward of the recess 47, extending outward of the rear-facing exterior surface 45 of the center segment 30A. The first layer 46A may be relatively hard in comparison to the second layer 46B. For example, the first layer 46A may be a first thermoplastic polyurethane and the second layer 46B may be a second thermoplastic polyurethane that is softer than the first thermoplastic polyurethane. The first and second layers 46A, 46B may be dual injected as a single piece cover 46 that snaps in as a unit into the recess 47 to cover the stitches 43. In some instances, a logo, lettering, or other graphics may be molded or printed on the exterior of the second layer 46B.

The heel portion 14E between the center segment 30A and the midsole 23 may be a flexible material, and may be a single layer. This promotes the folding of the heel portion 14E during depression of the control bar 30, as shown in FIG. 2. Although there is no heel counter at the flexible heel portion 14E between the center segment 30A and the midsole 23, because the device 22 extends at the lateral and medial sides 17, 19, the device 22 functions at least in some respects as a heel counter in that it helps to retain a wearer's heel in position atop the heel region 11 of the sole structure 12, limiting or preventing medial or lateral displacement during use.

The medial side arm 30B and the lateral side arm 30C resiliently bend to the loaded position of FIG. 2 when a downward force F (shown in FIG. 2) is applied to the center segment 30A of the control bar 30, such as by the foot 20 during entry into the foot-receiving cavity 16. The bent side arms 30B, 30C store potential energy that returns the control bar 30 to the unloaded position of FIG. 1 upon removal of the downward force F, such as when the foot 20 is fully inserted into the foot-receiving cavity 16 and no longer disposed above and applying downward force on the center segment 30A.

As shown in FIG. 2, contact of the foot 20 may be with a rear collar 40 that is secured to the heel portion 14E (see FIG. 8) at the rear 18B of the ankle opening 18 and extends above the center segment 30A. The force F may be transmitted to the control bar 30 through the rear collar 40, also referred to herein as an inner collar. The center segment 30A may include a ledge 42 that extends in a fore-aft (longitudinal) direction to provide a greater area over which the force F is dispersed and, likewise, a greater surface area on the foot 20 over which reaction forces are dispersed. The rear collar 40 is disposed at least partly over the ledge 42. The rear collar 40 may include an internal cushioning layer, such as a foam layer, for example. The foot 20 will make contact with the rear collar 40 during foot entry. The ledge 42 prevents potential foot discomfort that may otherwise occur if the upper extent of the center segment 30A had less surface area, as this would concentrate reaction forces on the foot 20. In FIG. 10, the device 22 is disposed more upright than when assembled on the footwear 10 as in FIG. 1.

In the unloaded position, the center segment 30A is a first distance D1 from the rear of sole structure 12, as indicated in FIG. 1 by a distance D1 from the top of the center segment 30A to the upper peripheral edge 44 of the midsole 23 below the center segment 30A. The unloaded position is the position of the device 22 in a relaxed, unloaded state (i.e., without the downward force F applied to the control bar 30).

The force F is first applied by the toes or ball of the foot, and then the foot slides forward into the foot-receiving cavity 16 as shown in FIG. 2 as the control bar 30 depresses to the loaded position. The force F could instead be applied by a hand or hands. When loaded in this manner, the control bar 30 elastically bends to the loaded position in which the center segment 30A is a second distance D2 from the sole structure 12, as shown in FIG. 2. The second distance D2 is less than the first distance D1 and is measured from the top of the control bar 30 at the center segment 30A to the upper peripheral edge 44 of the midsole 23 directly under the center segment 30A. The difference between the distances D1 and D2 is the amount of deflection of the device 22, which is dependent upon the level of force F applied. The device 22 is configured so that when it is depressed under the force F to the loaded position, the side arms 30B, 30C elastically bend, storing elastic energy. When the force F is removed, such as when the foot 20 is fully inserted, the stored elastic energy returns the control bar 30 to the unloaded position.

As shown in FIG. 2, the rear portion of the upper 14 (also referred to as the rear upper portion 14B) moves down with the control bar 30 to the loaded position. The flexibility of the heel portion 14E below the center segment 30A allows it to temporarily fold or deform. In FIG. 2 the rear upper portion 14B is shown folded inward at the position, but could instead fold outward, or may fold at more than one location, so that the rear upper portion 14B folds partially inward and partially outward. The stored elastic energy due to the bias of the device 22 automatically returns the device 22 to the unloaded position when the foot 20 moves fully into the foot-receiving cavity 16, causing the rear upper portion 14B to be automatically pulled up along the back of the foot 20.

Additionally, the relative dimensions and shape of the device 22 at the terminal ends 34, 36 (where secured to the midsole 23) and at the side arms 30B, 30C contributes to the spring-biased nature of the device 22 (e.g., its ability to elastically deform under a desired amount of loading and return to its original unloaded position). For example, the terminal ends 34, 36 of the side arms 30B, 30C have a thickness greater than a width, where the thickness is measured in the fore-aft (longitudinal) direction of the article of footwear 10 and the width is measured in the medial-lateral (transverse) direction of the article of footwear 10. The device 22 forms a medial joint 35 (see FIG. 3) between the medial terminal end 34 and the thinner portion of the medial side arm 30B nearer to the center segment 30A. The device 22 forms a lateral joint 37 (see FIG. 2) between the lateral terminal end 36 and the thinner portion of the lateral side arm 30C nearer to the center segment 30A. The joints 35, 37 are much thicker than the portions of the side arms 30B, 30C extending alongside the rear upper portion 14B, so that bending will occur at the side arms 30B, 30C above the joints 35, 37 under sufficient loading. The joints 35, 37 are also at least partially forward of the ends 34, 36. The thickness and the length of the side arms 30B, 30C, including at the terminal ends 34, 36 and the joints 35, 37 are selected along with the material of the device 22 to result in a desired level of force F required to resiliently bend the device 22 to the loaded position.

The device 22 may also be configured to widen as it is moved from the unloaded position to the loaded position. This helps ease insertion of the foot 20 into the foot-receiving cavity 16 as the side arms 30B, 30C may bow apart from one another when the control bar 30 is depressed, allowing the upper 14 to be stretched outward by the entering foot 20 without interference from the side arms 30B, 30C. The medial side arm 30B and the lateral side arm 30C are disposed outward of the front upper portion 14A and are not secured to the front upper portion 14A. Stated differently, the device 22 is only secured to the rear upper portion 14B at the center segment 30A and to the midsole 23 at the respective terminal ends 34, 36 of the medial and lateral side arms 30B, 30C. The device 22 is not secured to any part of the front upper portion 14A. Between the rear of the center segment 30A (where it is stitched to the collar 40 of the rear upper portion 14B) and the terminal ends 34, 36 of the side arms 30B, 30C secured to the side walls 27, 29 of the midsole 23, the device 22 is floating and not secured to either the rear upper portion 14B or the front upper portion 14A. The medial side arm 30B and the lateral side arm 30C are outwardly exposed. For example, the medial side arm 30B and the lateral side arm 30C are outwardly exposed at the medial side 19 and the lateral side 17 of the article of footwear 10, respectively. This allows the side arms 30B, 30C to bow outwardly under loading during foot entry without being restricted by the footwear upper 14.

The ribs 48 overlie the vamp portion 14C and extend to the upper peripheral edge 44 of the midsole at the medial side wall 27 and to the upper peripheral edge 44 of the midsole at the lateral side wall 29, as shown in FIGS. 1, 3, and 5. The ribs 48 are removed in FIG. 7. A mudguard skin 49 is secured to a base layer 51 of the front upper portion 14A and sits below the ribs 48. The ribs 48 may be flexible, but less so than the base layer 51, and may be relatively inextensible to help secure the foot within the foot-receiving cavity 16. The ribs 48 are the same in number as and are spaced apart from one another at generally the same spacing as grooves 50 in the midsole 23 (see FIGS. 1 and 3). The grooves 50 are in the ground-facing surface 26 of the midsole 23 and extend up onto the side walls 27, 29.

As best shown in FIG. 7, the front upper portion 14A of the footwear upper 14 extends in the forefoot region 15, the midfoot region 13, and the heel region 11 of the footwear upper 14. The ankle portion 14D that forms the medial grab handle 24A and the lateral grab handle 24B may have one or more inner foam layers as discussed herein, making the ankle portion 14D thicker than the base layer 51 in a direction from an exterior surface to an interior surface of the front upper portion 14A, allowing the ankle portion 14D to maintain an upright position even without the foot 20 in the foot-receiving cavity 16, as in FIGS. 1, 4, 5 and 7.

As best shown in FIGS. 5 and 6, the rear upper portion 14B includes the heel portion 14E and the rear collar 40 of the footwear upper 14 and extends around a rear of the heel region 11 and terminates at the medial side 19 and at the lateral side 17 of the footwear upper 14 inward of the front upper portion 14A, as further discussed with respect to FIGS. 5-8.

Referring to FIG. 3, the medial side 19 of the front upper portion 14A has a medial side wall, also referred to as a medial side outer wall 58 that includes the medial grab handle 24A and extends downward to the sole structure 12. The medial side outer wall 58 may be considered part of the ankle portion 14D and defines a medial aperture 60. The medial grab handle 24A includes a portion of the medial side outer wall 58 surrounding the medial aperture 60. The medial grab handle 24A is disposed above the medial side arm 30B and further above the sole structure 12 than the center segment 30A of the device 22. A medial grip 61 is secured to the medial side outer wall 58 at the medial aperture 60 and at least partially surrounds the medial aperture 60.

Referring to FIG. 7, the lateral side 17 of the front upper portion 14A has a lateral side wall, also referred to as a lateral side outer wall 59, that includes the lateral grab handle 24B and extends downward to the sole structure 12. The lateral side outer wall 59 may be considered part of the ankle portion 14D and defines a lateral aperture 64. The lateral grab handle 24B includes a portion of the lateral side outer wall 59 surrounding the lateral aperture 64. The lateral grab handle 24B is disposed above the lateral side arm 30C and further above the sole structure 12 than the center segment 30A of the device 22, as best shown in FIG. 1. A lateral grip 63 is secured to the lateral side outer wall 59 at the lateral aperture 64 and at least partially surrounds the lateral aperture 64.

FIGS. 4 and 5 show that the medial grip 61 includes an inner grip portion 61A at an inner surface 70 of the medial side outer wall 58. FIG. 3 shows that the medial grip 61 includes an outer grip portion 61B at an outer surface 72 of the medial side outer wall 58.

Similarly, FIGS. 4 and 5 show that the lateral grip 63 includes an inner grip portion 63A at an inner surface 74 of the lateral side outer wall 59. FIG. 1 shows that the lateral grip 63 includes an outer grip portion 63B at an outer surface 76 of the lateral side outer wall 59.

Figure 11:
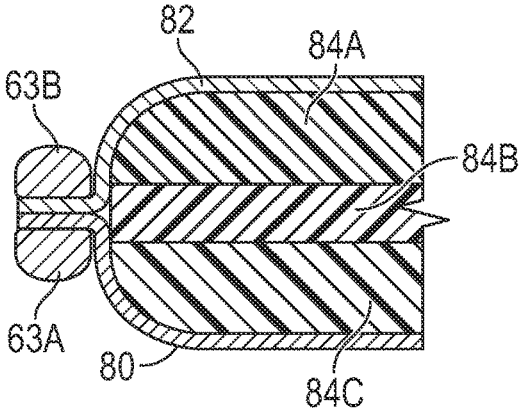
FIG. 11 is a cross-sectional view of the upper taken at lines 11-11 in FIG. 8.

Referring to FIG. 11, the front upper portion 14A includes an inner collar lining 80 and an outer mesh layer 82 that are secured to one another between the outer grip portion 63B and the inner grip portion 63A. Three different foam layers 84A, 84B, and 84C may have different thicknesses and or different densities and are disposed between the outer mesh layer 82 and the inner collar lining 80. The foam layers 84A, 84B, 84C enable the outer side walls 58, 59 to provide cushioning and remain upright even without an inserted foot.

As best shown in FIG. 5 and by comparing the position of the rear upper portion 14B on the midsole 23 in FIG. 6 with the position of the front upper portion 14A on the midsole 23 in FIG. 7, the front upper portion 14A and the rear upper portion 14B extend alongside one another at the medial side 19 and at the lateral side 17 with the rear upper portion 14B inward of the front upper portion 14A.

Furthermore, the rear upper portion 14B is at least partially decoupled from the front upper portion 14A at the medial side 19 and at the lateral side 17. More specifically, the front upper portion 14A and the rear upper portion 14B overlap at and are at least partially decoupled from one another at the medial side 19 and at the lateral side 17 as discussed herein to enable movement of the rear upper portion 14B with the control bar 30 independently of the front upper portion 14A. This decoupling of the front upper portion 14A and the rear upper portion 14B may enable the ankle opening 18 to open to a greater extent when the control bar 30 is depressed than if the front upper portion 14A were more fully coupled to the rear upper portion 14B.

Referring to FIGS. 4 and 5, the front upper portion 14A terminates at a rear medial edge 86 of the medial side outer wall 58 at the medial side 19 of the article of footwear 10. The rear medial edge 86 is inward of the medial side arm 30B, and is partially covered by the medial side arm 30B when the device 22 is in the unloaded position (e.g., the rear medial edge 86 is covered in FIG. 3). The front upper portion 14A includes a first segment 86A and a second segment 86B at the medial side 19. More specifically, the rear medial edge 86 of the front upper portion includes a first segment 86A and a second segment 86B (best shown in FIG. 5). The first segment 86A of the rear medial edge 86 is adjacent to the ankle opening 18. The second segment 86B of the rear medial edge 86 is indicated in hidden lines in FIG. 5 and is between the first segment 86A of the rear medial edge 86 and the sole structure 12 (e.g., the second segment 86B is closer to the sole structure 12 than the first segment 86A).

Figure 8:
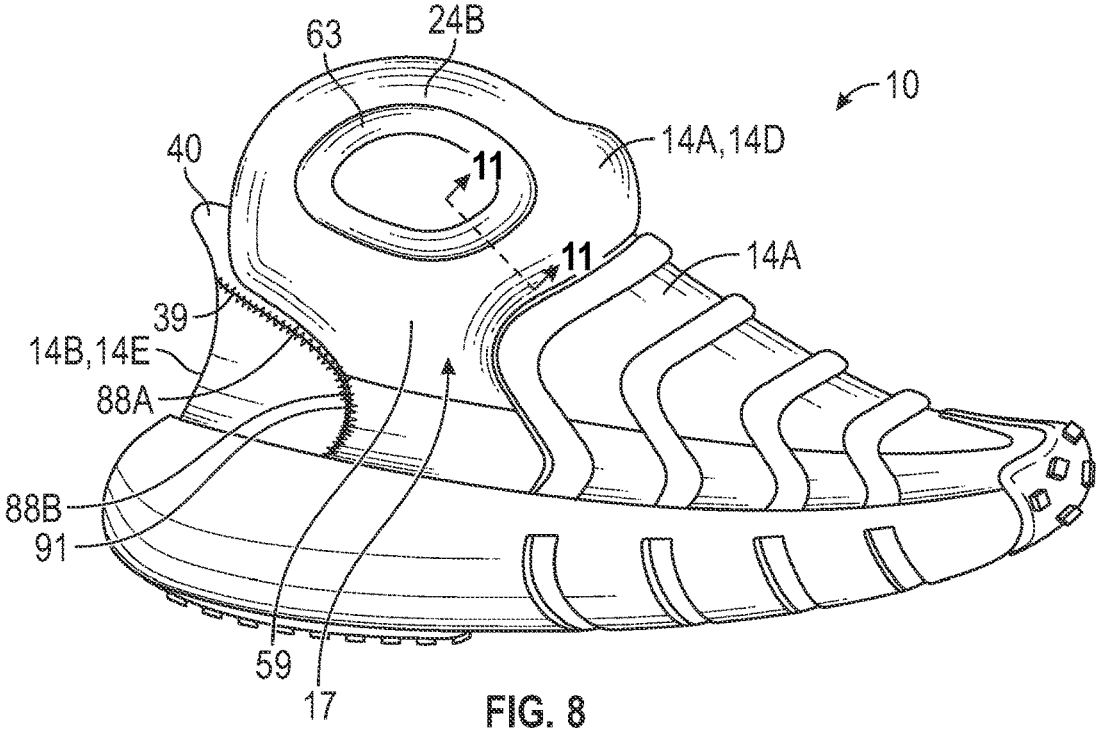
FIG. 8 is a lateral side view of the article of footwear of FIG. 1 showing the sole structure and both the front upper portion and the rear upper portion, and with the device for easing foot entry not shown for clarity.

Referring to FIGS. 7 and 8, the front upper portion 14A terminates at a rear lateral edge 88 of the lateral side outer wall 59 at the lateral side 17 of the article of footwear 10 inward of the lateral side arm 30C, as can be determined by comparing FIG. 1 to FIG. 2 and the position of the rear lateral edge 88 in FIG. 7. The rear lateral edge 88 is inward of the lateral side arm 30C, and partially covered by the lateral side arm 30C when the device 22 is in the unloaded position. The rear lateral edge 88 is best viewed in FIGS. 7 and 8 where the device 22 is removed. The front upper portion 14A includes a first segment 88A and a second segment 88B at the lateral side 17. More specifically, the rear lateral edge 88 of the front upper portion 14A includes a first segment 88A and a second segment 88B. The first segment 88A of the rear lateral edge 88 is adjacent to the ankle opening 18 and the second segment 88B of the rear lateral edge 88 is between the first segment 88A of the rear lateral edge 88 and the sole structure 12 (e.g., the second segment 88B is closer to the sole structure 12 than the first segment 88A).

Referring to FIGS. 5 and 6, the rear upper portion 14B includes a medial side inner wall 90 and a lateral side inner wall 92. The medial side inner wall 90 extends forward from the rear 18B of the ankle opening 18 inward of the medial side outer wall 58. The lateral side inner wall 92 extends forward from the rear 18B of the ankle opening 18 inward of the lateral side outer wall 59. The medial side inner wall 90 terminates at a front medial edge 94 (indicated with hidden lines in FIG. 5) forward of the rear medial edge 86 of the medial side outer wall 58. The lateral side inner wall 92 terminates at a front lateral edge 96 forward of the rear lateral edge 88 of the lateral side outer wall 59. The front lateral edge 96 is indicated in hidden lines in FIG. 5, and is fully visible in FIG. 6. The front medial edge 94 is generally at the same for-aft location along the midsole 23 as is the front lateral edge 96, but at the medial side 19. With these positions of the rear medial and rear lateral edges 86, 88 relative to the front medial and lateral edges 94, 96, it is clear that the outer side walls 58, 59 overlap the respective inner side walls 90, 92 of the rear upper portion 14B along the respective medial side 19 and lateral side 17.

Although the outer side walls 58, 59 overlap the respective inner side walls 90, 92, they are at least partially decoupled from the inner side walls 90, 92 in order to allow less restricted movement of the device 22 (and the heel portion 14E secured thereto) to the loaded position for easier foot entry. More specifically, the first segments 86A, 88A of the rear medial edge 86 and the rear lateral edge 88 are decoupled from the rear upper portion 14B. The front upper portion 14A is secured to the rear upper portion 14B at the second segment 86B of the rear medial edge 86 and at the second segment 88B of the rear lateral edge 88, but is decoupled from the rear upper portion 14B at the first segment 86A of the rear medial edge 86 and at the first segment 88A of the rear lateral edge 88. This is best shown with respect to the rear lateral edge 88 in FIG. 8 where stitching 91 extends only over the second segment 88B to secure the second segment 88B to the rear upper portion 14B. The rear medial edge 86 is similarly secured to the rear upper portion 14B at the second segment 86B but not at the first segment 86A. The first segments 86A, 88A may be said to be floating relative to the rear upper portion 14B and also relative to the device 22. No part of the device 22 is secured to the front upper portion 14A. As best seen in FIG. 2, the first segment 88A of the rear lateral edge 88 is not secured to either the device 22 or the rear upper portion 14B. When the device 22 pulls downward on the rear upper portion 14B due to the securement of the center segment 30A to the heel portion 14E, the rear upper portion 14B may in turn pull on the front upper portion 14A at the second segments 86B, 88B but will not pull at the floating, decoupled first segments 86A, 88A. This decoupling lessens the resistive forces of the upper 14 on the device 22 as the device 22 moves from the unloaded position of FIG. 1 to the loaded position of FIG. 2.

Figure 12:
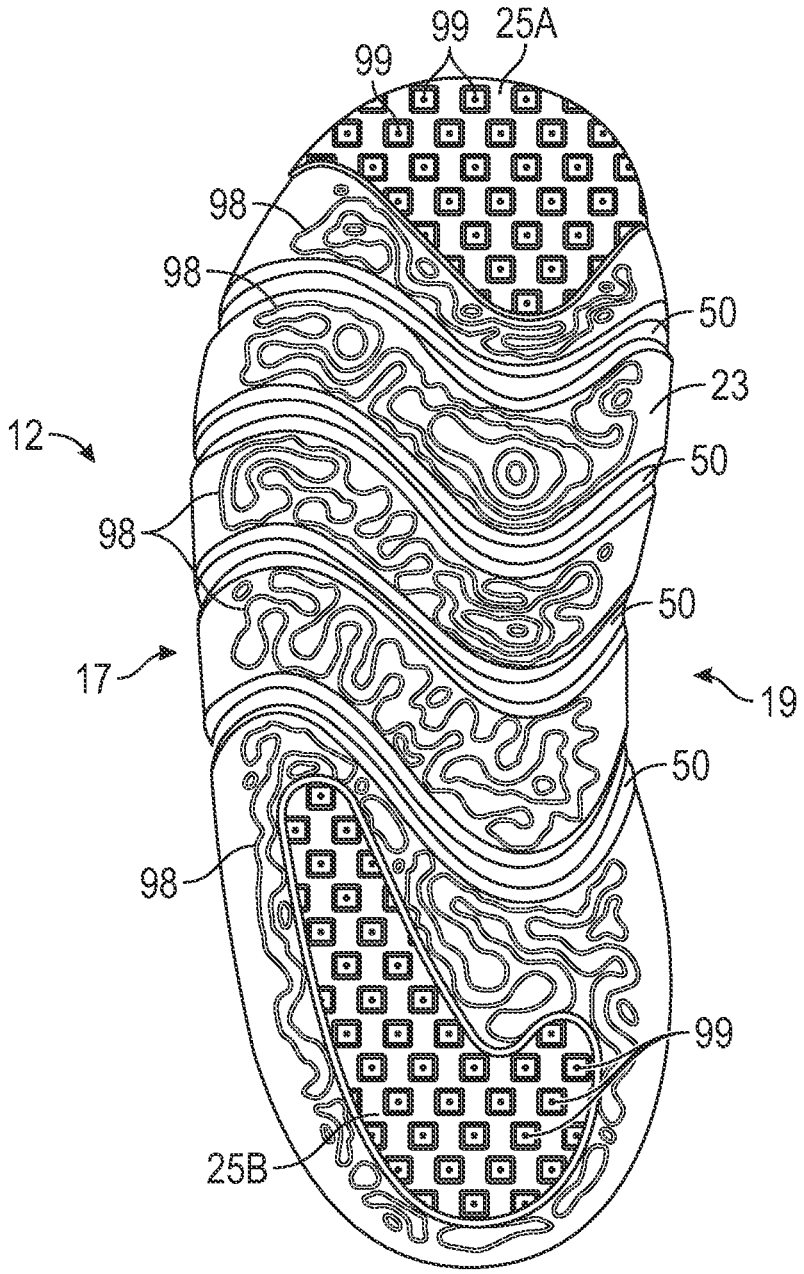
FIG. 12 is a bottom view of the sole structure of the article of footwear of FIG. 1.

FIG. 12 is a bottom view of the sole structure 12. The grooves 50 are shown extending from the lateral side 17 to the medial side 19 of the midsole 23. The midsole 23 also includes secondary grooves 98 that are not as deep as the grooves 50. The outsole components 25A, 25B have protruding lugs 99 for increasing traction. As is evident in FIGS. 1 and 5, the front outsole component 25A wraps up over the front of the front upper portion 14A, serving as a toe cap.

Figure 13:
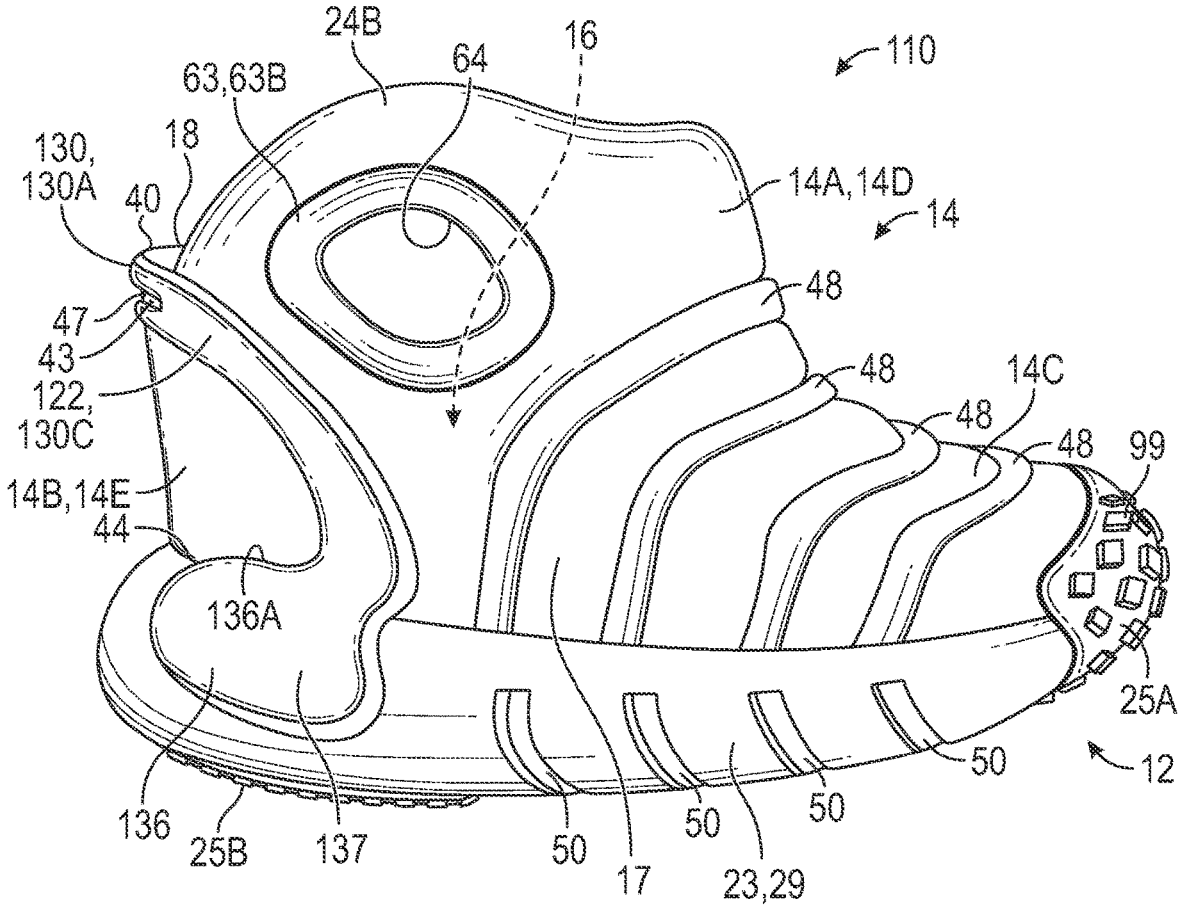
FIG. 13 is a lateral side view of an alternative embodiment of an article of footwear including an alternative device for easing foot entry shown in an unloaded position and including a handle for easing foot entry.

FIG. 13 is a lateral side view of another embodiment of an article of footwear 110. The article of footwear 110 includes many of the same components of the article of footwear 10 that are referred to with like reference numbers and function as described with respect to the article of footwear 10, although the components may differ in scale as the article of footwear 110 shown may be for a different size foot than the article of footwear 10.

The article of footwear 110 includes a device 122 that functions the same as the device 22 to enable easy entry into the foot-receiving cavity 16, but has some structural differences. The device 122 includes a control bar 130 having a center segment 130A, a medial side arm 130B (shown in FIG. 14), and a lateral side arm 130C. The center segment 130A is secured to the rear portion 14B of the footwear upper 14 rearward of the ankle opening 18. The medial side arm 130B extends downwardly and forwardly from the center segment 130A at the medial side of the footwear upper 14 and is fixed to the midsole 23. The lateral side arm 130C extends downwardly and forwardly from the center segment 130A at the lateral side 17 of the footwear upper 14 and is fixed to the midsole 23. The midsole 23 has slight recesses where terminal ends of the arms 130B, 130C are nested. The lateral terminal end 136 is shown in FIGS. 13 and 14 and the top of the medial terminal end 134 is partly visible in FIG. 14.

In comparison to the ends 34, 36 of the device 22, the lateral terminal end 136 shown and the similar medial terminal end 134 of the device 122 are slightly shorter in the fore-aft direction. The side arms 130B, 130C also extend downward from the center segment 130A more sharply (e.g., at a greater angle relative to a horizontal ground plane) than the more gradual downward and forward extension of the side arms 30B, 30C from the center segment 30A. Stated differently, the side arms 130B, 130C incline at a greater angle from near the midsole 23 to the center segment 130A than do the side arms 30B, 30C. This allows the center segment 130A to rest higher on the rear upper portion 14B in the unloaded state of FIG. 13 (e.g., closer to the top of the collar 40).

Additionally, the side arms 130B, 130C are thinner just above medial and lateral joints (lateral joint 137 shown in FIG. 13) than are the side arms 30B, 30C. Stated differently, the side arms 30B, 30C of the device 22 widen in the fore-aft (longitudinal) direction as they extend further from the center segment 30A. The side arms 130B, 130C widen much less than the side arms 30B, 30C so that a ratio of the thickness of the center segment 130A (from its top edge to its bottom edge) to the width of the lateral side arm 130C at its widest portion (just above the upper peripheral edge 44 of the midsole 23) is greater than the ratio of the thickness of the center segment 30A to the width of the lateral side arm 30C of the device 22 at its widest portion.

Figure 14:
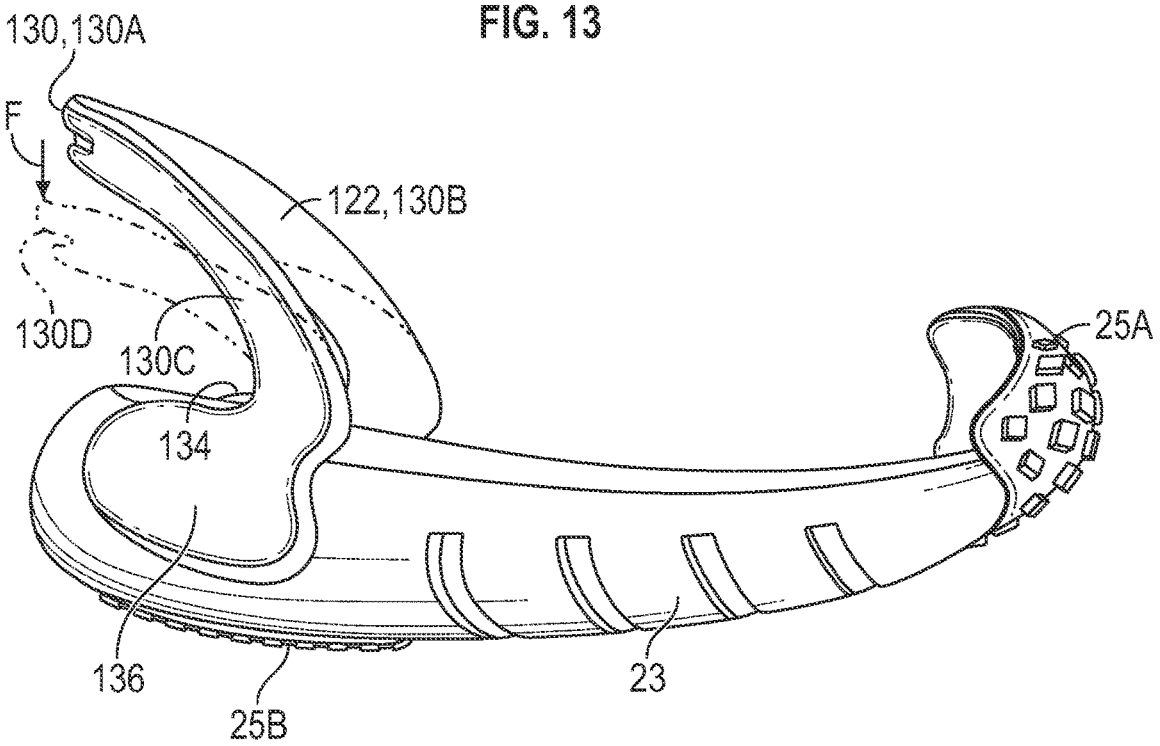
FIG. 14 is a lateral side view of the sole structure and the device of the article of footwear of FIG. 13, with the upper not shown for clarity, and with a loaded position of the device shown in phantom.

The thinner side arms 130B, 130C near the midsole 23 as well as the more sharply declining angle of the side arms 130B, 130C may cause bending of the side arms 130B, 130C to occur further toward the sole structure 12 than side arms 30B, 30C, which may enable the center segment 130A to be disposed further rearward relative to the rear of the midsole 23 than the center segment 30A when in the loaded state shown in phantom in FIG. 14 at 130D, causing the rear upper portion 14B to also be pulled further rearward. These differences may further enable easy entry into the foot-receiving cavity 16.

The control bar 130 depresses downward under an applied force F to a loaded position shown in phantom in FIG. 14 at 130D as the medial side arm 130B and the lateral side arm 130C resiliently bend, storing potential energy that returns the control bar 130 back to the unloaded position upon removal of the applied force F. The rear portion 14B of the footwear upper 14 moves with the control bar 130. Accordingly, when a foot depresses the control bar 130, it becomes easy to slide the foot through the ankle opening 18 into the foot-receiving cavity 16.

Like the center segment 30A, the center segment 130A is stitched to the rear portion 14B at a recess 47 with stitches extending through the center segment 130A at the recess 47 (like stitches 43 shown in FIG. 4). However, no cover like cover 46 of FIG. 9 is disposed in the recess 47 of the center segment 130A over the stitches 43.

Figure 15:
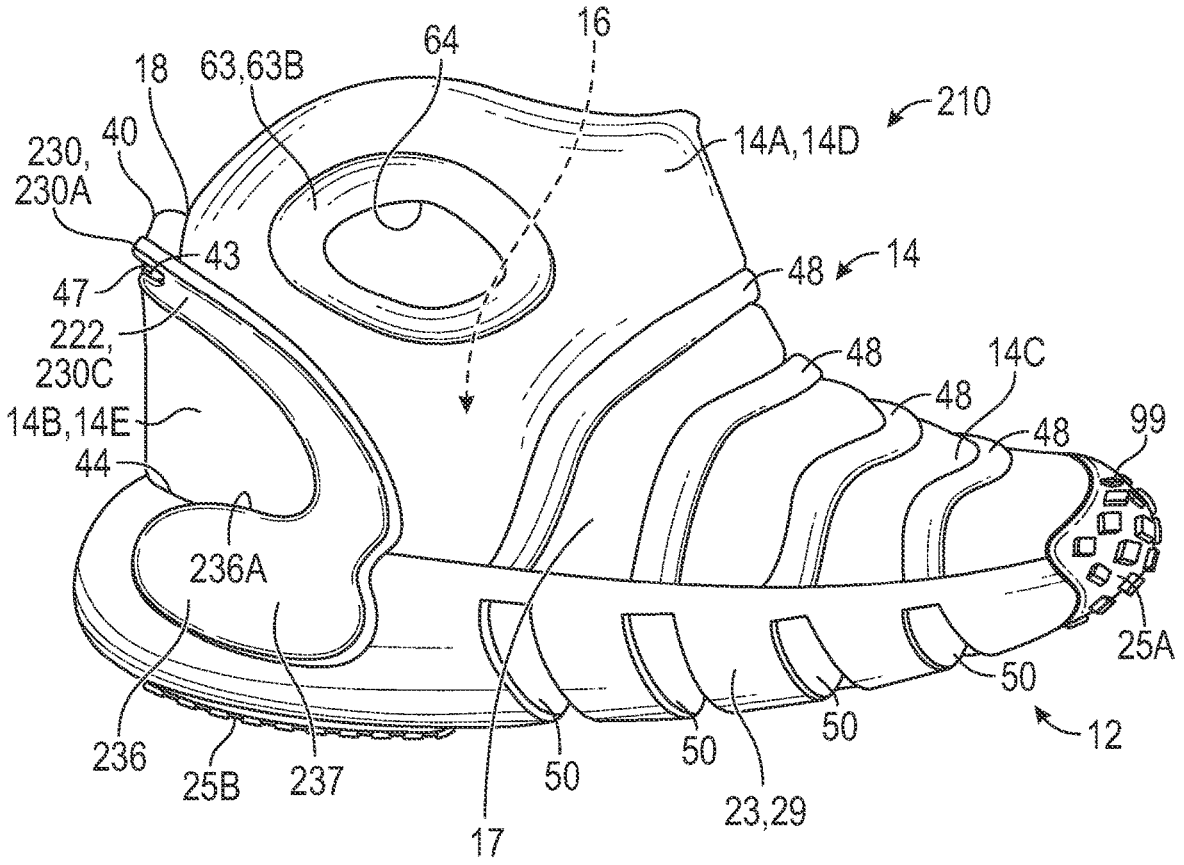
FIG. 15 is a lateral side view of another alternative embodiment of an article of footwear including an alternative device for easing foot entry shown in an unloaded position and including a handle for easing foot entry.

FIG. 15 is a lateral side view of another embodiment of an article of footwear 210. The article of footwear 210 includes many of the same components of the article of footwear 10 that are referred to with like reference numbers and function as described with respect to the article of footwear 10, although the components may differ in scale only as the article of footwear 210 shown may be for a different size foot than the article of footwear 10.

Figure 16:
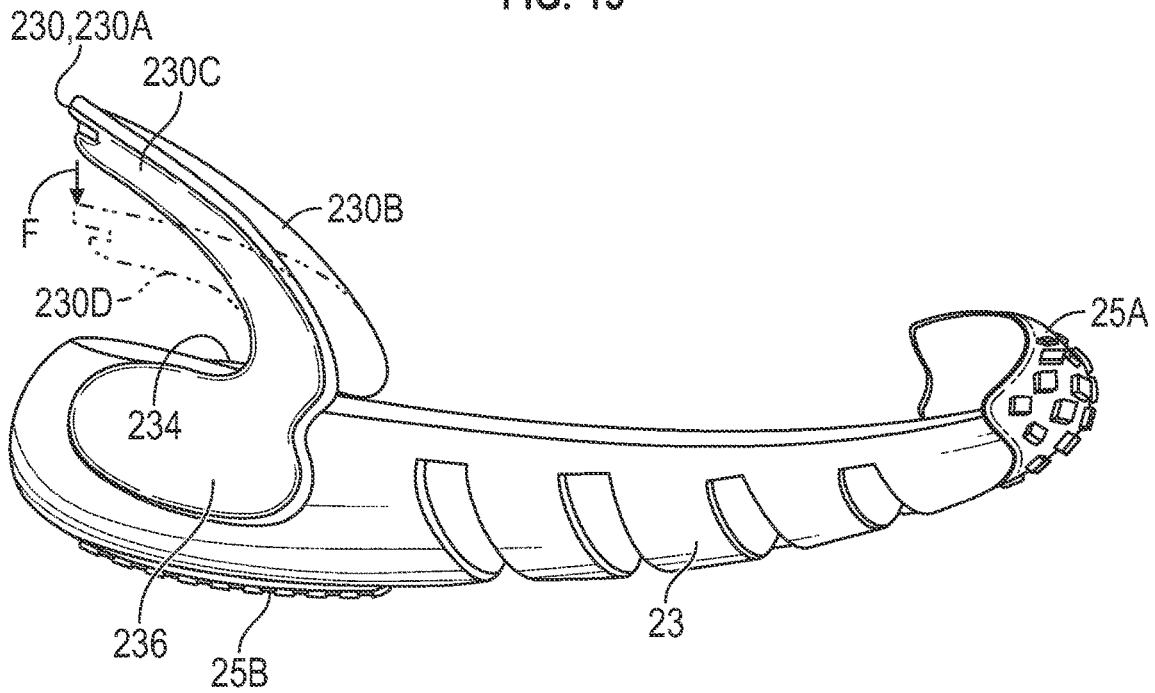
FIG. 16 is a lateral side view of the sole structure and the device of the article of footwear of FIG. 15, with the upper not shown for clarity, and with a loaded position of the device shown in phantom.

The article of footwear 210 includes a device 222 that functions the same as the device 22 to enable easy entry into the foot-receiving cavity 16, but has some structural differences. The device 222 includes a control bar 230 having a center segment 230A, a medial side arm 230B (shown in FIG. 16), and a lateral side arm 230C. The center segment 230A is secured to the rear portion 14B of the footwear upper 14 rearward of the ankle opening 18. The medial side arm 230B extends downwardly and forwardly from the center segment 230A at the medial side of the footwear upper 14 and is fixed to the midsole 23. The lateral side arm 230C extends downwardly and forwardly from the center segment 230A at the lateral side 17 of the footwear upper 14 and is fixed to the midsole 23. The midsole 23 has slight recesses where ends of the arms 230B, 230C are nested. The lateral terminal end 236 is shown in FIGS. 15 and 16.

In comparison to the ends 34, 36 of the device 22, the lateral terminal end 236 shown and the similar medial terminal end of the device 222 are slightly shorter in the fore-aft direction. In comparison to the device 122, the lateral terminal end 236 shown and the similar medial terminal end 234 of the device 222 have a top edge 236A that falls closer to the upper peripheral edge 44 of the midsole 23 than does the top edge 136A of the lateral terminal end 136 in FIG. 13. Additionally, both the top edge 136A of the lateral terminal end 136 and the top edge of the medial terminal end 134 of the device 122 and the top edge 236A of the lateral terminal end 236 and the top edge of the medial terminal end 234 of the device 222 are closer to parallel with the upper peripheral edge 44 of the midsole 23 (and closer to parallel with a horizontal ground plane underlying the article of footwear 110 or 210) than are the top edge 36A (see FIG. 1) and the top edge 34A (see FIG. 3) of the medial terminal end 34 of the device 22.

The side arms 230B, 230C also extend downward from the center segment 230A more sharply (e.g., at a greater angle relative to a horizontal ground plane) than the more gradual downward and forward extension of the side arms 30B, 30C from the center segment 30A. Stated differently, the side arms 230B, 230C incline at a greater angle from near the midsole 23 to the center segment 230A than do the side arms 30B, 30C. This allows the center segment 230A to rest higher on the rear upper portion 14B in the unloaded state of FIG. 15 (e.g., closer to the top of the collar 40).

Additionally, the side arms 230B, 230C are thinner just above medial and lateral joints (lateral joint 237 shown in FIG. 15) than are the side arms 30B, 30C. Stated differently, the side arms 30B, 30C of the device 22 widen in the fore-aft (longitudinal) direction as they extend further from the center segment 30A. The side arms 230B, 230C widen much less than the side arms 30B, 30C so that a ratio of the thickness of the center segment 230A (from its top edge to its bottom edge) to the width of the lateral side arm 230C at its widest portion (just above the upper peripheral edge 44 of the midsole 23) is greater than the ratio of the thickness of the center segment 30A to the width of the lateral side arm 30C of the device 22 at its widest portion.

The thinner side arms 230B, 230C near the midsole 23 as well as the more sharply declining angle of the side arms 230B, 230C may cause bending of the side arms 230B, 230C to occur further toward the sole structure 12 than side arms 30B, 30C, which may enable the center segment 230A to be disposed further rearward relative to the rear of the midsole 23 than the center segment 30A when in the loaded state shown in phantom in FIG. 16 at 230D, causing the rear upper portion 14B to also be pulled further rearward. These differences may further enable easy entry into the foot-receiving cavity 16.

The control bar 230 depresses downward under an applied force F to a loaded position shown in phantom in FIG. 16 at 230D as the medial side arm 230B and the lateral side arm 230C resiliently bend, storing potential energy that returns the control bar 230 back to the unloaded position upon removal of the applied force F. The rear portion 14B of the footwear upper 14 moves with the control bar 230. Accordingly, when a foot depresses the control bar 230, it becomes easy to slide the foot through the ankle opening 18 into the foot-receiving cavity 16.

Like the center segment 30A, the center segment 230A is stitched to the rear portion 14B at a recess 47 with stitches extending through the center segment 230A at the recess 47 (like stitches 43 shown in FIG. 4). However, no cover like cover 46 of FIG. 9 is disposed in the recess 47 of the center segment 230A over the stitches 43.

The following Clauses provide example configurations of an article of footwear disclosed herein.

Clause 1. An article of footwear comprising: a sole structure; a footwear upper secured to the sole structure and defining an ankle opening; and a device comprising a control bar having: a center segment secured to a rear portion of the footwear upper rearward of the ankle opening; a medial side arm extending downwardly and forwardly from the center segment at a medial side of the footwear upper and fixed to the sole structure; and a lateral side arm extending downwardly and forwardly from the center segment at a lateral side of the footwear upper and fixed to the sole structure; wherein the footwear upper has at least one of a medial grab handle at the medial side of the footwear upper or a lateral grab handle at a lateral side of the footwear upper; and wherein the control bar depresses downward under an applied force to a loaded position as the medial side arm and the lateral side arm resiliently bend, storing potential energy that returns the control bar to an unloaded position upon removal of the applied force, the rear portion of the footwear upper moving with the control bar.

Clause 2. The article of footwear of clause 1, wherein: the medial side of the footwear upper includes a medial side wall that defines a medial aperture; the medial grab handle includes a portion of the medial side wall surrounding the medial aperture; the lateral side of the footwear upper includes a lateral side wall that defines a lateral aperture; and the lateral grab handle includes a portion of the lateral side wall surrounding the lateral aperture.

Clause 3. The article of footwear of clause 2, wherein: the medial grab handle is disposed above the medial side arm and further above the sole structure than the center segment of the device; and the lateral grab handle is disposed above the lateral side arm and further above the sole structure than the center segment of the device.

Clause 4. The article of footwear of clause 2, further comprising: a medial grip secured to the medial side wall at the medial aperture and at least partially surrounding the medial aperture; and a lateral grip secured to the lateral side wall at the lateral aperture and at least partially surrounding the lateral aperture.

Clause 5. The article of footwear of clause 4, wherein: the medial grip includes an inner grip portion at an inner surface of the medial side wall and an outer grip portion at an outer surface of the medial side wall; and the lateral grip includes an inner grip portion at an inner surface of the lateral side wall and an outer grip portion at an outer surface of the lateral side wall.

Clause 6. The article of footwear of any of clauses 1-5, wherein the rear portion of the footwear upper includes a rear collar at a rear of the ankle opening that extends above the center segment of the device.

Clause 7. The article of footwear of clause 6, wherein the center segment of the device has a rear-facing exterior surface with a recess, and the rear collar is stitched to the center segment at the recess with stitches; and the article of footwear further comprising: a cover disposed in the recess over the stitches.

Clause 8. The article of footwear of any of clauses 1-7, wherein the footwear upper extends further above the sole structure at a front of the ankle opening than at the center segment.

Clause 9. The article of footwear of clause 8, wherein: the footwear upper includes a front upper portion that includes the medial grab handle and the lateral grab handle and defines a front of the ankle opening; the footwear upper includes a rear upper portion that includes the rear portion secured to the center segment, the rear upper portion defining a rear of the ankle opening; and the front upper portion and the rear upper portion extend alongside one another at the medial side and at the lateral side with the rear upper portion inward of the front upper portion and are at least partially decoupled from one another at the medial side and at the lateral side.

Clause 10. The article of footwear of clause 9, wherein: the front upper portion has a medial side outer wall with the medial grab handle and a lateral side outer wall with the lateral grab handle, the front upper portion terminating at a rear medial edge of the medial side outer wall at the medial side of the article of footwear inward of the medial side arm, and terminating at a rear lateral edge of the lateral side outer wall at the lateral side of the article of footwear inward of the lateral side arm; and the rear upper portion includes a medial side inner wall and a lateral side inner wall, the medial side inner wall extending forward from the rear of the ankle opening inward of the medial side outer wall and terminating at a front medial edge forward of the rear medial edge of the medial side outer wall, and the lateral side inner wall extending forward from the rear of the ankle opening inward of the lateral side outer wall and terminating at a front lateral edge forward of the rear lateral edge of the lateral side outer wall.

Clause 11. The article of footwear of clause 10, wherein: the rear medial edge of the front upper portion includes a first segment and a second segment, the first segment of the rear medial edge is adjacent to the ankle opening and the second segment of the rear medial edge is between the first segment of the rear medial edge and the sole structure; and the front upper portion is secured to the rear upper portion at the second segment of the rear medial edge and at the second segment of the rear lateral edge, and is decoupled from the rear upper portion at the first segment of the rear medial edge and at the first segment of the rear lateral edge.

Clause 12. The article of footwear of clause 9, wherein: the front upper portion has a medial side outer wall with the medial grab handle and a lateral side outer wall with the lateral grab handle; the rear upper portion includes a medial side inner wall and a lateral side inner wall, the medial side inner wall extending forward from the rear of the ankle opening inward of the medial side outer wall, and the lateral side inner wall extending forward from the rear of the ankle opening inward of the lateral side outer wall; the medial side outer wall includes a first segment and a second segment, the first segment is adjacent to the ankle opening and the second segment is between the first segment and the sole structure; the lateral side outer wall includes a first segment and a second segment, the first segment of the lateral side outer wall is adjacent to the ankle opening and the second segment of the lateral side outer wall is between the first segment of the lateral side outer wall and the sole structure; and the front upper portion is secured to the rear upper portion at the second segment of the medial side outer wall and at the second segment of the lateral side outer wall, and is decoupled from the rear upper portion at the first segment of the medial side outer wall and at the first segment of the lateral side outer wall.

Clause 13. The article of footwear of clause 9, wherein the medial side arm and the lateral side arm are disposed outward of the front upper portion and are not secured to the front upper portion.

Clause 14. The article of footwear of clause 9, wherein the front upper portion includes a vamp portion and an ankle portion integral with the vamp portion and disposed at a front of the ankle opening.

Clause 15. The article of footwear of any of clauses 1-14, wherein: the medial side arm includes a medial terminal end of the device that terminates on and is secured to a medial side wall of the sole structure; the lateral side arm includes a lateral terminal end of the device that terminates on and is secured to a lateral side wall of the sole structure; and the device defines a gap between the medial terminal end of the device and the lateral terminal end of the device.

Clause 16. An article of footwear comprising: a sole structure; a footwear upper having a front upper portion secured to the sole structure and a rear upper portion secured to the sole structure, the front upper portion defining a front of an ankle opening and the rear upper portion defining a rear of the ankle opening; and a device comprising a control bar having: a center segment secured to the rear upper portion rearward of the ankle opening; a medial side arm extending downwardly and forwardly from the center segment at a medial side of the article of footwear outward of the footwear upper and fixed to the sole structure; and a lateral side arm extending downwardly and forwardly from the center segment at a lateral side of the article of footwear outward of the footwear upper and fixed to the sole structure; wherein the control bar depresses under an applied force to a loaded position as the medial side arm and the lateral side arm resiliently bend, storing potential energy that returns the control bar to an unloaded position upon removal of the applied force, the rear upper portion moving with the control bar; and wherein the front upper portion and the rear upper portion overlap at and are at least partially decoupled from one another at the medial side and at the lateral side to enable movement of the rear upper portion with the control bar independently of the front upper portion.

Clause 17. The article of footwear of clause 16, wherein: the front upper portion extends in a forefoot region, a midfoot region, and a heel region of the footwear upper and terminates at the medial side and at the lateral side of the footwear upper inward of the medial side arm and the lateral side arm and forward of the center segment; and the rear upper portion extends around a rear of the heel region and terminates at the medial side and at the lateral side of the footwear upper inward of the front upper portion.

Clause 18. The article of footwear of clause 17, wherein the medial side arm and the lateral side arm and are not secured to the front upper portion.

Clause 19. The article of footwear of any of clauses 16-18, wherein the rear upper portion includes a rear collar at a rear of the ankle opening that extends above the center segment of the device.

Clause 20. The article of footwear of any of clauses 16-19, wherein: the front upper portion has a medial side outer wall and a lateral side outer wall; the rear upper portion includes a medial side inner wall and a lateral side inner wall, the medial side inner wall extending forward from the rear of the ankle opening inward of the medial side outer wall, and the lateral side inner wall extending forward from the rear of the ankle opening inward of the lateral side outer wall; the medial side outer wall includes a first segment and a second segment, the first segment is adjacent to the ankle opening and the second segment is between the first segment and the sole structure; the lateral side outer wall includes a first segment and a second segment, the first segment of the lateral side outer wall is adjacent to the ankle opening and the second segment of the lateral side outer wall is between the first segment of the lateral side outer wall and the sole structure; and the front upper portion is secured to the rear upper portion at the second segment of the medial side outer wall and at the second segment of the lateral side outer wall, and is decoupled from the rear upper portion at the first segment of the medial side outer wall and at the first segment of the lateral side outer wall.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure;

a footwear upper secured to the sole structure and defining an ankle opening; the footwear upper including a front upper portion that defines a front of the ankle opening and a rear upper portion that defines a rear of the ankle opening; and a device comprising a control bar having:

a center segment secured to the rear upper portion of the ankle opening;

a medial side arm extending downwardly and forwardly from the center segment at a medial side of the footwear upper and fixed to the sole structure; and a lateral side arm extending downwardly and forwardly from the center segment at a lateral side of the footwear upper and fixed to the sole structure;

wherein the front upper portion has at least one of a medial grab handle at the medial side of the footwear upper or a lateral grab handle at a lateral side of the footwear upper;

wherein the control bar depresses downward under an applied force to a loaded position as the medial side arm and the lateral side arm resiliently bend, storing potential energy that returns the control bar to an unloaded position upon removal of the applied force, the rear upper portion moving with the control bar;

wherein the rear upper portion extends forward to the sole structure inward of the front upper portion at the medial side and at the lateral side of the article of footwear;

wherein the front upper portion has a medial side outer wall and a lateral side outer wall, the medial side outer wall including the medial grab handle and/or the lateral side outer wall including the lateral grab handle, the front upper portion terminating at a rear medial edge of the medial side outer wall at the medial side of the article of footwear inward of the medial side arm, and terminating at a rear lateral edge of the lateral side outer wall at the lateral side of the article of footwear inward of the lateral side arm;

wherein the rear upper portion includes a medial side inner wall and a lateral side inner wall, the medial side inner wall extending forward from the rear of the ankle opening inward of the medial side outer wall and terminating at the sole structure at a front medial edge forward of the rear medial edge of the medial side outer wall, and the lateral side inner wall extending forward from the rear of the ankle opening inward of the lateral side outer wall and terminating at the sole structure at a front lateral edge forward of the rear lateral edge of the lateral side outer wall;

wherein the rear medial edge of the medial side outer wall includes a first segment and a second segment, the first segment of the rear medial edge of the medial side outer wall is adjacent to the ankle opening and the second segment of the rear medial edge of the medial side outer wall is between the first segment of the rear medial edge of the medial side outer wall and the sole structure and further forward than the first segment of the medial side outer wall;

wherein the rear lateral edge of the later side outer wall includes a first segment and a second segment, the first segment of the rear lateral edge of the lateral side outer wall is adjacent to the ankle opening and the second segment of the rear lateral edge of the lateral side outer wall is between the first segment of the rear lateral edge of the lateral side outer wall and the sole structure and further forward than the first segment of the rear lateral edge of the later side outer wall; and wherein the front upper portion is secured to the rear upper portion at the second segment of the rear medial edge of the medial side outer wall and at the second segment of the rear lateral edge of the lateral side outer wall, and is decoupled from the rear upper portion at the first segment of the rear medial edge of the medial side outer wall and at the first segment of the rear lateral edge of the lateral side outer wall.

2. The article of footwear of claim 1, wherein:

the medial side outer wall defines a medial aperture;

the medial grab handle includes a portion of the medial side outer wall surrounding the medial aperture;

the lateral side outer wall defines a lateral aperture; and the lateral grab handle includes a portion of the lateral side outer wall surrounding the lateral aperture.

3. The article of footwear of claim 2, wherein:

the medial grab handle is disposed above the medial side arm and further above the sole structure than the center segment of the device; and the lateral grab handle is disposed above the lateral side arm and further above the sole structure than the center segment of the device.

4. The article of footwear of claim 2, further comprising:

a medial grip secured to the medial side outer wall at the medial aperture and at least partially surrounding the medial aperture; and a lateral grip secured to the lateral side outer wall at the lateral aperture and at least partially surrounding the lateral aperture.

5. The article of footwear of claim 4, wherein:

the medial grip includes an inner grip portion at an inner surface of the medial side outer wall and an outer grip portion at an outer surface of the medial side outer wall; and the lateral grip includes an inner grip portion at an inner surface of the lateral side outer wall and an outer grip portion at an outer surface of the lateral side outer wall.

6. The article of footwear of claim 1, wherein the rear upper portion includes a rear collar at a rear of the ankle opening that extends above the center segment of the device; and wherein the article of footwear is characterized by the absence of a heel counter rearward of the ankle opening.

7. The article of footwear of claim 6, wherein the center segment of the device has a rear-facing exterior surface with a recess, and the rear collar is stitched to the center segment at the recess with stitches; and the article of footwear further comprising:

a cover disposed in the recess over the stitches.

8. The article of footwear of claim 1, wherein the footwear upper extends further above the sole structure at a front of the ankle opening than at the center segment.

9. The article of footwear of claim 1, wherein:

the footwear upper portion and the rear upper portion extend alongside one another at the medial side and at the lateral side in a midfoot region of the article of footwear.

10. The article of footwear of claim 1, wherein the medial side arm and the lateral side arm are disposed outward of the front upper portion and are not directly secured to the front upper portion.

11. The article of footwear of claim 1, wherein the front upper portion includes a vamp portion and an ankle portion integral with the vamp portion and disposed at a front of the ankle opening.

12. The article of footwear of claim 1, wherein:

the medial side arm includes a medial terminal end of the device that terminates on and is secured to a medial side wall of the sole structure;

the lateral side arm includes a lateral terminal end of the device that terminates on and is secured to a lateral side wall of the sole structure; and the device defines a gap between the medial terminal end of the device and the lateral terminal end of the device.

13. An article of footwear comprising:

a sole structure;

a footwear upper having a front upper portion secured to the sole structure and a rear upper portion secured to the sole structure, the front upper portion defining a front of an ankle opening and the rear upper portion defining a rear of the ankle opening; and a device comprising a control bar having:

a center segment secured to the rear upper portion rearward of the ankle opening;

a medial side arm extending downwardly and forwardly from the center segment at a medial side of the article of footwear outward of the footwear upper and fixed to the sole structure; and a lateral side arm extending downwardly and forwardly from the center segment at a lateral side of the article of footwear outward of the footwear upper and fixed to the sole structure;

the control bar depresses under an applied force to a loaded position as the medial side arm and the lateral side arm resiliently bend, storing potential energy that returns the control bar to an unloaded position upon removal of the applied force, the rear upper portion moving with the control bar;

the front upper portion and the rear upper portion overlap at and are at least partially decoupled from one another at the medial side and at the lateral side to enable movement of the rear upper portion with the control bar independently of the front upper portion the front upper portion has a medial side outer wall and a lateral side outer wall;

the rear upper portion includes a medial side inner wall and a lateral side inner wall, the medial side inner wall extending forward from the rear of the ankle opening inward of the medial side outer wall to the sole structure, and the lateral side inner wall extending forward from the rear of the ankle opening inward of the lateral side outer wall to the sole structure;

a rear medial edge of the medial side outer wall includes a first segment and a second segment, the first segment of the rear medial edge of the medial side outer wall is adjacent to the ankle opening and the second segment of the rear medial edge of the medial side outer wall is between the first segment of the rear medial edge of the medial side outer wall and the sole structure and further forward than the first segment of the rear medial edge of the medial side outer wall;

a rear lateral edge of the lateral side outer wall includes a first segment and a second segment, the first segment of the rear lateral edge of the lateral side outer wall is adjacent to the ankle opening and the second segment of the rear lateral edge of the lateral side outer wall is between the first segment of the rear lateral edge of the lateral side outer wall and the sole structure and further forward than the first segment of the rear lateral edge of the lateral side outer wall; and the front upper portion is secured to the rear upper portion at the second segment of the rear medial edge of the medial side outer wall and at the second segment of the rear lateral edge of the lateral side outer wall, and is decoupled from the rear upper portion at the first segment of the rear medial edge of the medial side outer wall and at the first segment of the rear lateral edge of the lateral side outer wall.

14. The article of footwear of claim 13, wherein:

the front upper portion extends in a forefoot region, a midfoot region, and a heel region of the footwear upper and terminates at the medial side and at the lateral side of the footwear upper inward of the medial side arm and the lateral side arm and forward of the center segment; and the rear upper portion extends around a rear of the heel region and terminates at the medial side and at the lateral side of the footwear upper inward of the front upper portion and forward of the heel region.

15. The article of footwear of claim 14, wherein the medial side arm and the lateral side arm and are not secured to the front upper portion.

16. The article of footwear of claim 13, wherein the rear upper portion includes a rear collar at a rear of the ankle opening that extends above the center segment of the device.

* * * * *